US005887288A

United States Patent [19]

Arney et al.

[11] Patent Number: 5,887,288

[45] **Date of Patent: *Mar. 30, 1999**

[54] SIZING AND STABILIZING APPARATUS FOR BICYCLE HELMETS

[75] Inventors: Michel D. Arney, Needham; Andrew G. Zeigler, Arlington; Thomas H. Burchard, Winchester; Terrence K. Jones, Sharon, all of Mass.

[73] Assignee: Bell Sports, Inc., San Jose, Calif.

[ * ] Notice: The term of this patent shall not extend beyond the expiration date of Pat. No. 5,659,900.

[21] Appl. No.: 432,123

[22] Filed: Oct. 19, 1995

Related U.S. Application Data

[63] Continuation-in-part of Ser. No. 88,878, Jul. 8, 1993, Pat. No. 5,659,900.

[51] Int. Cl.[6] ..... A42B 3/08

[52] U.S. Cl. ..... 2/421; 2/417; 2/425

[58] Field of Search ..... 2/410, 411, 414, 2/415, 416, 417, 418, 421, 422, 425

[56] References Cited

U.S. PATENT DOCUMENTS

| | | | |
|---|---|---|---|
| 1,522,952 | 1/1925 | Goldsmith . | |
| 3,103,014 | 1/1962 | Morgan . | |
| 3,130,415 | 4/1964 | Colley | 2/415 |
| 3,139,623 | 7/1964 | Joseph, Jr. | 2/415 |
| 3,230,544 | 1/1966 | Mager | 2/415 |
| 3,323,134 | 6/1967 | Swyers | 2/421 |
| 3,510,879 | 5/1970 | Webb . | |
| 3,591,863 | 7/1971 | Rickard | 2/421 |
| 3,609,763 | 10/1971 | Raney . | |
| 3,852,821 | 12/1974 | Mickel | 2/421 |
| 3,873,997 | 4/1975 | Gooding . | |
| 3,925,821 | 12/1975 | Lewicki | 2/425 |
| 3,991,423 | 11/1976 | Jones | 2/415 |
| 4,263,679 | 4/1981 | Erlendson | 2/421 |
| 4,319,362 | 3/1982 | Ettinger . | |
| 4,796,309 | 1/1989 | Nava . | |
| 5,315,718 | 5/1994 | Barson et al. | 2/421 |
| 5,381,560 | 1/1995 | Halstead | 2/421 |
| 5,551,094 | 9/1996 | Navone | 2/421 |
| 5,581,819 | 12/1996 | Garneau | 2/421 |

FOREIGN PATENT DOCUMENTS

| | | |
|---|---|---|
| 1144682 | 3/1969 | United Kingdom . |
| 2 021 387 | 12/1979 | United Kingdom . |

*Primary Examiner*—Michael A. Neas
*Attorney, Agent, or Firm*—Limbach & Limbach LLP

[57] ABSTRACT

A bicycle helmet is disclosed having a flexible, articulated member depending from the rear of the helmet, providing a closer fit to an individual wearer's head and improving stability of the helmet on the head, particularly for mountain bike riding. The articulated member contacts the wearer's head beneath the occipital region and applies a forward and upward pressure against the head. The general embodiment of the invention includes an elastic strap stretching from one side of the helmet, across the back of the articulated member, to the opposite side of the helmet. Adjusting this strap allows the wearer to adjust the forward and upward pressure exerted by the articulated member on the wearer's head.

26 Claims, 19 Drawing Sheets

SIZING AND STABILIZING APPARATUS FOR BICYCLE HELMETS

RELATED APPLICATIONS

This application is a continuation in part of co-pending application Ser. No. 08/088,878, now U.S. Pat. No. 5,659,900, filed Jul. 8, 1993 through PCT Application PCT/US94/07643, filed Jul. 8, 1995.

BACKGROUND OF THE INVENTION

1. Field of the Invention

The present invention relates to bicycle helmets, in particular to sizing and stabilizing a mountain bike helmet on a rider's head.

2. Discussion of the Prior Art

Lightweight helmets for head protection during bicycle riding falls and accidents have continuously evolved and undergone numerous improvements in recent years. One particular area of refinement has been in the fitting and stabilizing of helmets on the bicycle rider's head. An example of a prior art bicycle helmet and a means for securing it from excessive movement is disclosed in U.S. Pat. No. 4,903,350.

In order to fit a variety of head shapes and sizes, a particular brand of helmet often will be available in several sizes. Each size typically can be customized to a particular wearer's head by inserting or removing cushions and pads around the interior of the helmet cavity to obtain a snug fit.

Chin straps are employed to keep the helmet on. These straps reduce the vertical movement of the helmet relative to the wearer's head, but provide little resistance to the forward and back rocking motion of the helmet. Many helmet models now employ chin straps having a "Y" configuration on each side. A loop is attached to the front and rear of each side of the helmet, and these two loops are connected by a strap beneath the wearer's chin. An example of this type of prior art helmet and strap arrangement is also disclosed by U.S. Pat. No. 4,903,350. While this type of chin strap reduces the amount of helmet movement, it does not eliminate it.

The sport of mountain bike riding has grown increasingly popular in recent years. This activity involves riding specially designed bicycles with heavy duty frames and components on unpaved roads, trails and rough terrain. Experienced mountain bike riders can travel over steep drops, uneven terrain, boulders, stumps, logs, creek beds, and such while on their mountain bikes. Conventional bicycle helmets are typically used for protection from falls. The bouncing, bumping and jarring associated with mountain bike riding greatly exacerbates the problem of excessive helmet movement on the rider's head. Bike riders traveling on dirt roads or even city streets will often experience these problems. A tightly fitted helmet with a taut chin strap may reduce the amount of movement of the helmet on the wearer's head, but usually provides more of a discomfort than a solution to the problem.

Prior art bicycle helmets have not utilized the undercut portion beneath the occipital region of the wearer's head to stabilize the helmet. There are two apparent reasons for this. The first is that the process used to mold a one piece main shell of the helmet can not tolerate a negative draft angle without prohibitively expensive multi-part molds to allow removal of the helmet after molding. The second reason concerns the difficulty or impossibility of the wearer fitting the helmet over his or her head if the helmet contains a substantial inward curve to match the undercut portion of the back of the head.

SUMMARY OF THE INVENTION

Broadly stated, the present invention, to be described in greater detail below, is directed to a bicycle helmet having an articulated member for engaging the head of the wearer.

In accordance with one aspect of the present invention, an articulated member is biased against the occipital region of the wearer's head, allowing the helmet to more closely fit a larger range of head sizes and shapes.

In accordance with another aspect of the present invention, the occipital region of the wearer's head is elastically retained between a rear articulated member and the inside of the main shell portion of the helmet. Because the occipital region is cradled from both above and below, the helmet is comfortably secured and movement of the helmet on the wearer's head is greatly reduced or eliminated.

DETAILED DESCRIPTION OF THE PREFERRED EMBODIMENTS

Figure 1:
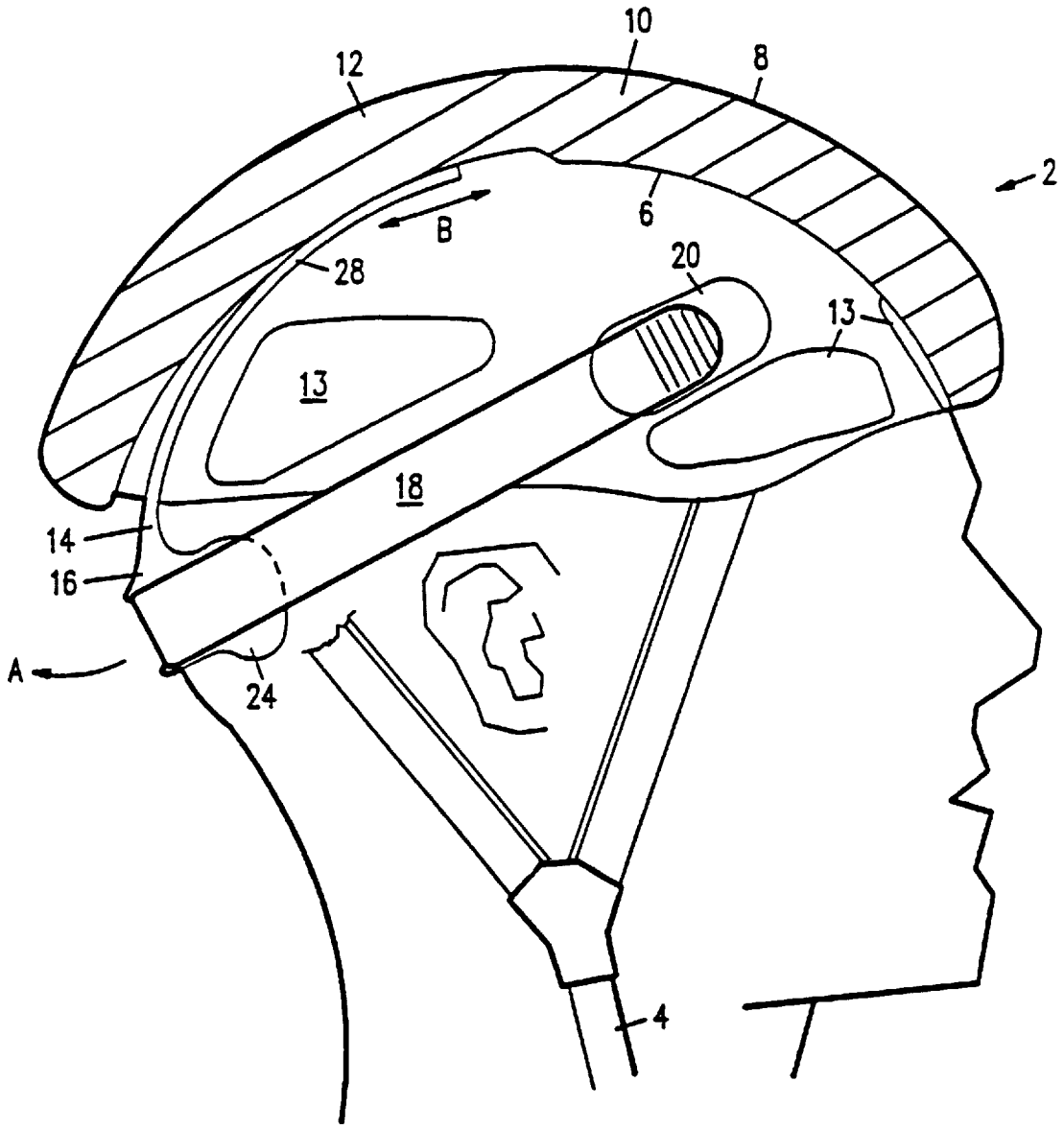
FIG. 1 is a fragmentary side elevation view showing a general embodiment of the inventive helmet.

Referring to FIG. 1, in which the general embodiment of the present invention is shown, the main shell 2 of the helmet is secured to the wearer's head by a chin strap 4. The main shell 2 has an interior surface 6 defining a helmet cavity for receiving the wearer's head, and an exterior surface 8. The helmet can be further defined by a top portion fiting over the top of the head of a wearer and with a front half 10 and a rear half 12. Removable pads 13 are attached to the central top interior surface 6 of main shell 2 for obtaining a proper fit for a particular wearer. A flexible articulated member 14 is attached to the interior 6 of the top portion of the main shell 2 forward of the back of the neck of a wearer near the front of the shell rear half 10 and extends downward and inward, generally along the interior surface 6 of the rear half 12 and extending beyond the lower edge of the helmet. In the general embodiment, when the articulated member 14 is in a relaxed state when the helmet is not being worn, articulated member 14 curves inward more than shown in FIG. 1. As the helmet is placed on the wearer's head, articulated member 14 flexes rearward in the direction of arrow A to accommodate the head, then returns partially forward underneath the occipital region of the head when the helmet is all the way on. The flexing portion of the articulated essentially forms a hinge that allows the wearer to flex the articulated member back to allow the helmet to fit over the wearer's head. Once the helmet is on, the articulated member 14 flexes forward again to contact the back of the head. Because articulated member 14 is being displaced when worn, it exerts a forward pressure on the back of the head. The flexed portion of the displaced articulated arm 14 acts as a spring to exert the forward pressure on the back of the head. This forward pressure provides a snug yet comfortable fit which greatly increases the stability of the helmet. Because the occipital region of the wearer's head is cradled from below by the articulated member 14, the helmet is restrained from rocking forward and back, and from bouncing around on the wearer's head.

Figure 2:
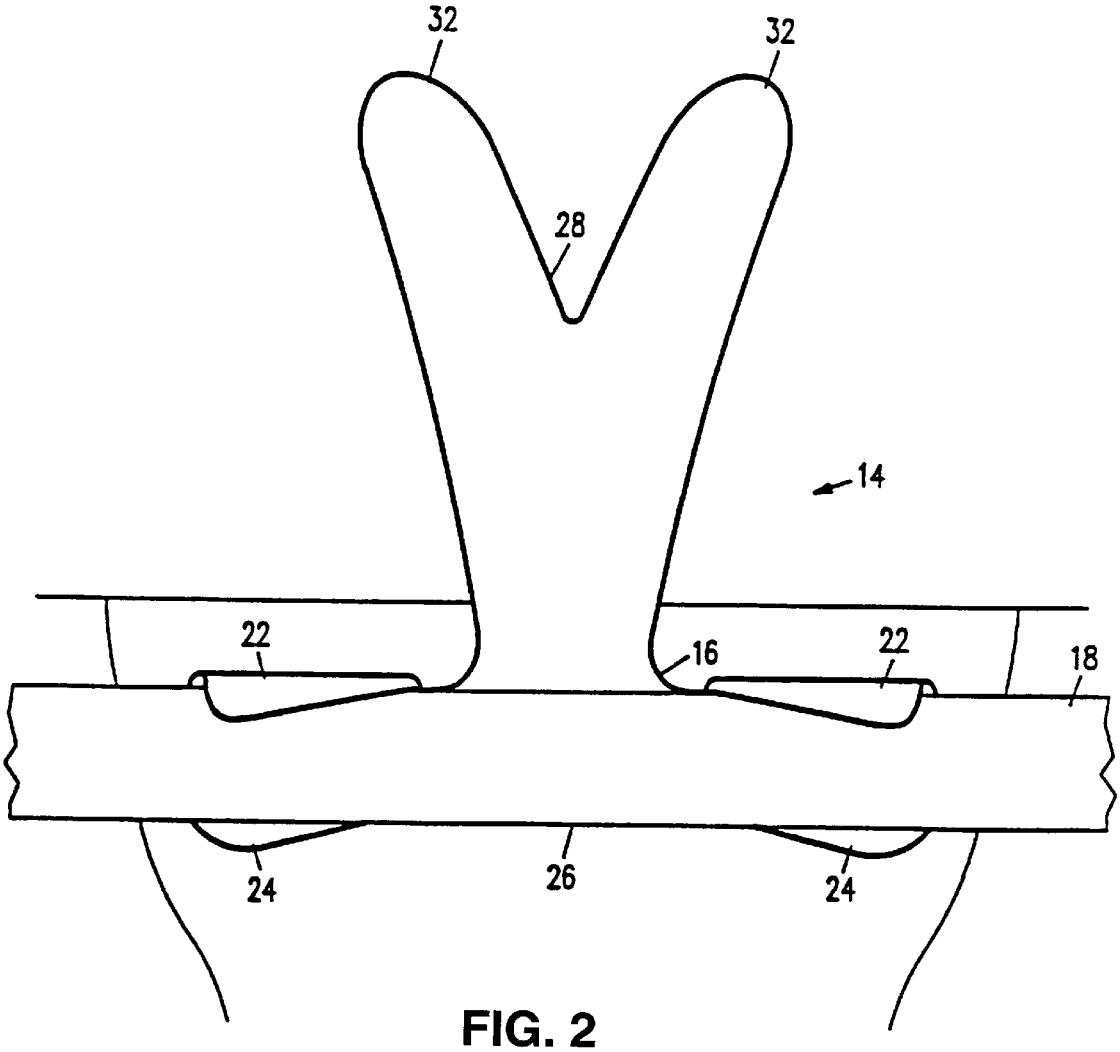
FIG. 2 is a rear elevation view showing the articulated member of a general embodiment.

FIG. 2 shows the T-shaped distal end 16 of articulated member 14. The distal end 16 of the articulated member 14 is also curved in a lateral direction. The curvature in this direction is designed to approximate the curvature of the corresponding portion of the wearer's head, and if necessary, to flex in the lateral direction to accommodate the head.

An elastic strap 18 is provided to increase, and preferably also to adjust, the forward pressure exerted by the flexed articulated member 14 against the back of the user's head. In the general embodiment shown in FIGS. 1 and 2, a one piece strap 18 is attached at both its ends to the interior 6 of the sides of the main shell 2. The middle portion of strap 18 is guided across the back of the distal end 16 of articulated member 14. When the helmet is worn, strap 18 stretches, thereby adding to the forward flexing force of the articulated member 14. The location of the attachment points on the main shell 2 is such that the strap 18 biases the distal end 16 of articulated member 14 upward and inward against the inwardly curving portion of the occipital region of the wearer's head.

In the general embodiment, strap 18 is attached at both ends to the main shell 2 with hook and loop type fasteners. The preferred embodiment uses VELCRO® hook and loop type fasteners. A small patch 20 of the hook portion of the fastener is bonded to each side of the main shell 2 on the interior surface 6 just above and forward of the wearer's ears. The entire strap 18 is made from an elastic fabric with a nap suitable for releasably adhering to patches 20 inside the main shell 2. The forward and upward tension that the strap 18 imparts to the wearer's head through the articulated member 14 can be increased or decreased by moving one or both ends of the strap 18 forward or back, respectively, in relation to the patches 20. This is done with the helmet off in the general embodiment. Alternatively, one end of the strap 18 can be made adjustable, with the other end being fixed.

Figure 6:
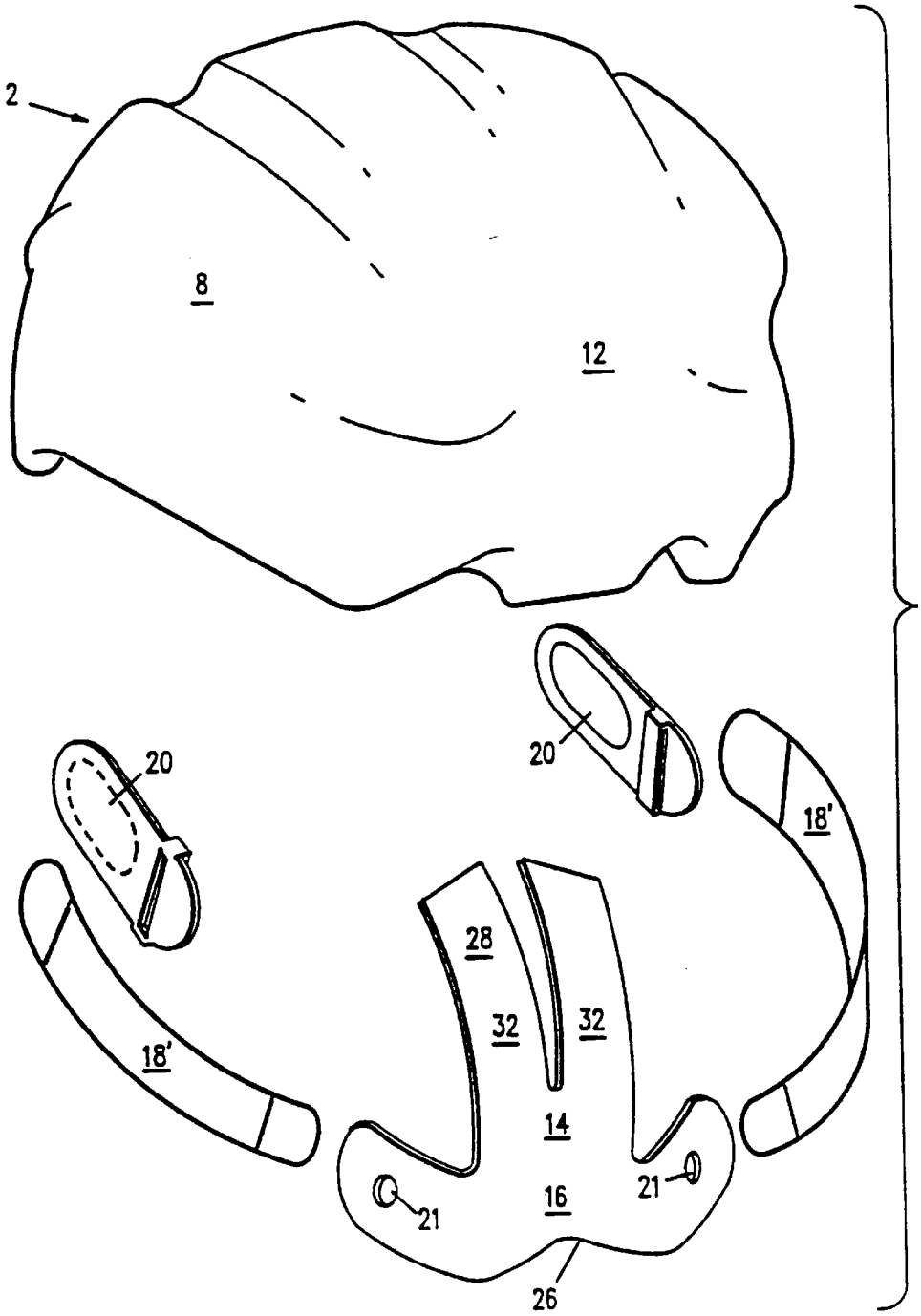
FIG. 6 is an exploded rear perspective view showing an alternate embodiment.

In an alternative embodiment, shown in FIG. 6, two straps 18' can be used, with each strap 18' spanning between one side of the distal end 16 of the articulated member 14 and the adjacent side of the main shell 2. The straps 18' can be attached with snaps 21 to the distal end 16 of the articulated member 14. The opposite ends of straps 18' are then adjustably attached to the main shell 2 in a similar manner to that previously described. In another variation of the two strap embodiment (not shown), one end of each strap is attached to the inside of the helmet, while the other end is adjustably attached to the distal end 16 of the articulated member 14, allowing the strap tension to be adjusted while the helmet is being worn.

Figure 5:
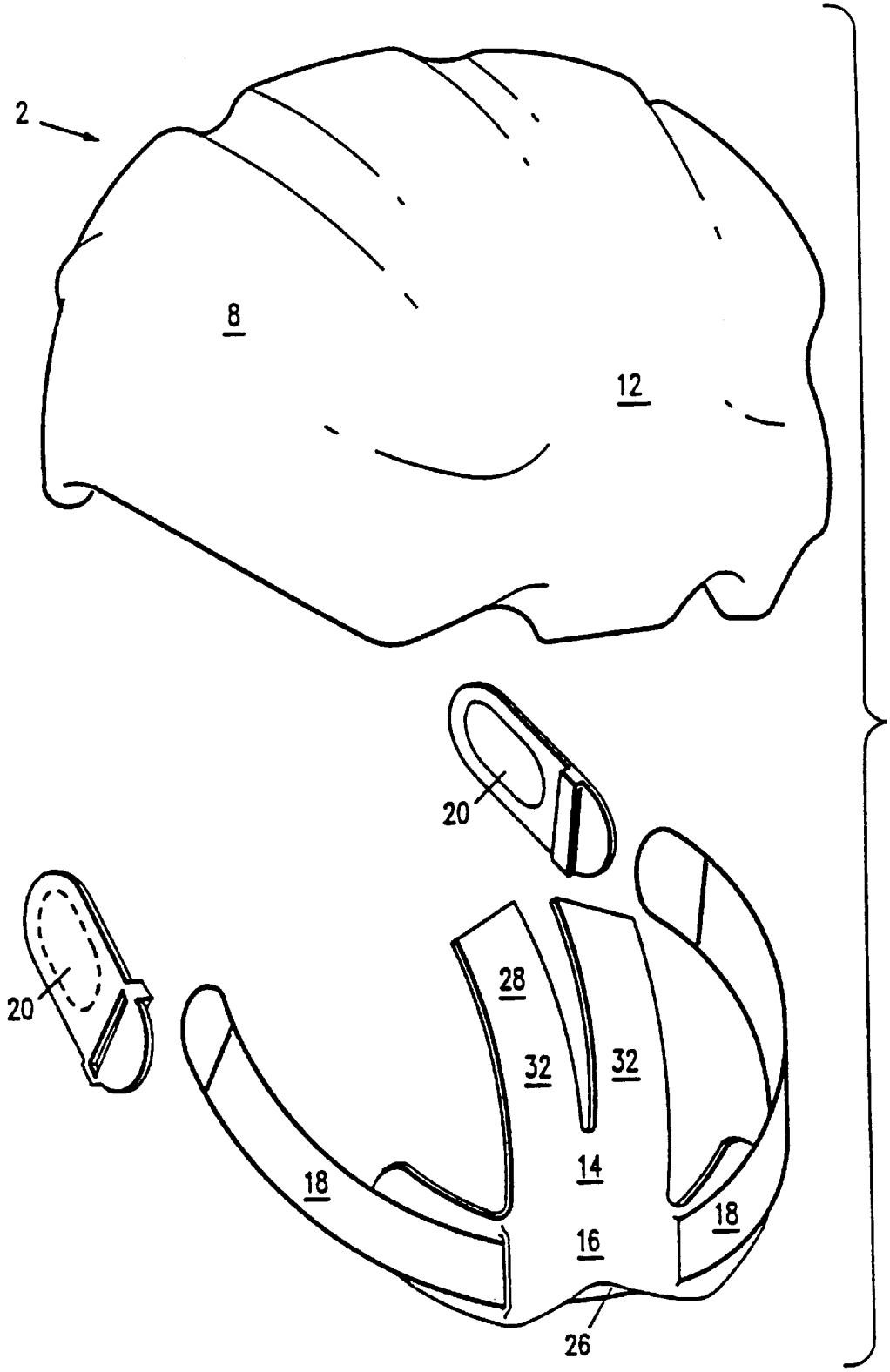
FIG. 5 is an exploded rear perspective view showing an alternate embodiment.
Figure 7:
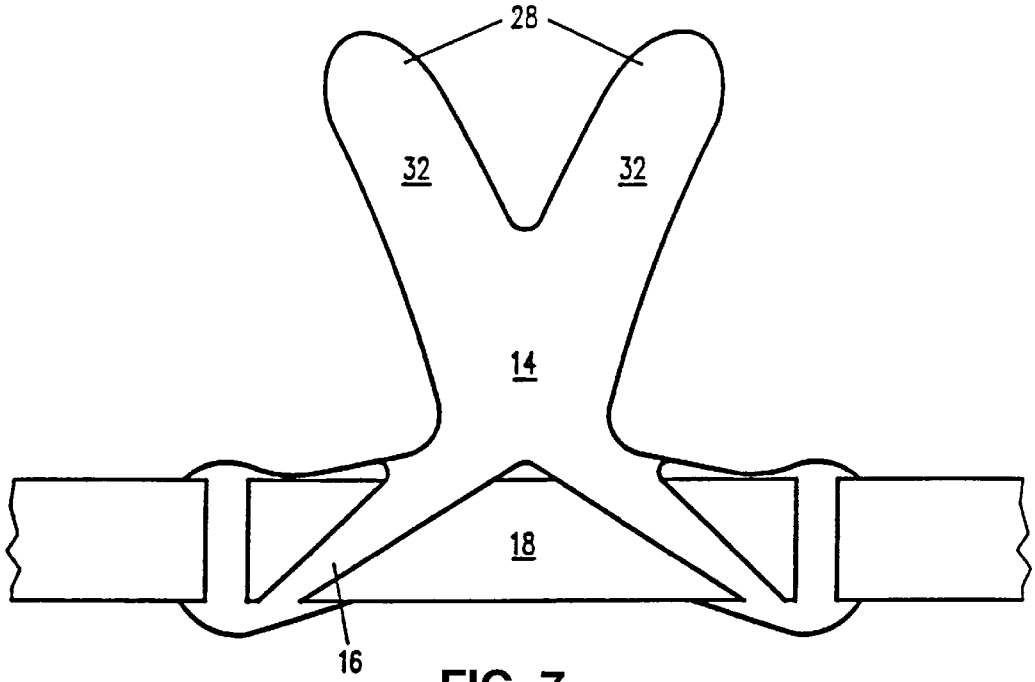
FIG. 7 is a rear elevation view showing the articulated member of an alternate embodiment.
Figure 8:
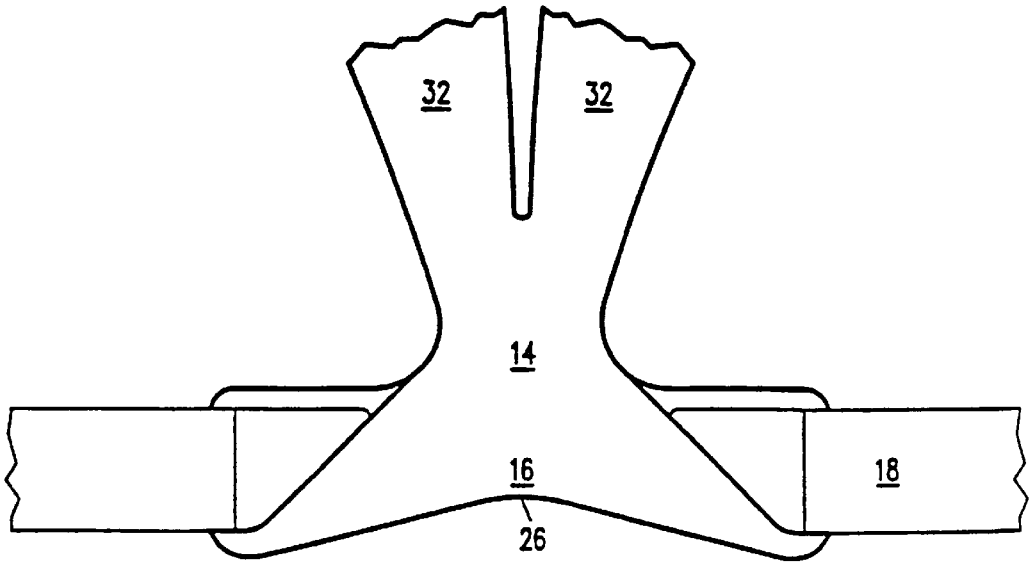
FIG. 8 is a rear elevation view showing the articulated member of an alternate embodiment.

In the general embodiment shown in FIG. 2, inverted J-shaped hold downs 22 are provided on the upper outside ends of the T-shaped distal end 16 of the articulated member 14. These hold downs 22 capture the upper edge of strap 18 and prevent it from sliding upwards and off the T-shaped distal end 16 of the articulated member 14. Similarly, outward bends 24 are provided near the lower edge of articulated member 14 to inhibit strap 18 from sliding off the bottom of articulated member 14. In alternative embodiments, strap 18 can be captivated by clips or guide slots in the distal end 16 of the articulated member 14, as shown in FIGS. 5, 7 and 8.

As shown in FIGS. 1 and 2, outward bends 24 also serve to comfortably guide the leading edge (lower edge) of the articulated member 14 over the head when the wearer puts the helmet on. Recess 26 is provided at the lower edge of the articulated member 14 to accommodate the wearer's neck (or hair, such as when worn in a ponytail) when the wearer is in a forward leaning, bicycle riding position. Recess 26 and outward bends 24 allow articulated member 14 to comfortably exert a constant forward and upward pressure on the occipital region of the wearer's head without binding or digging in, regardless of the front to back tilt of the wearer's head.

Figure 3:
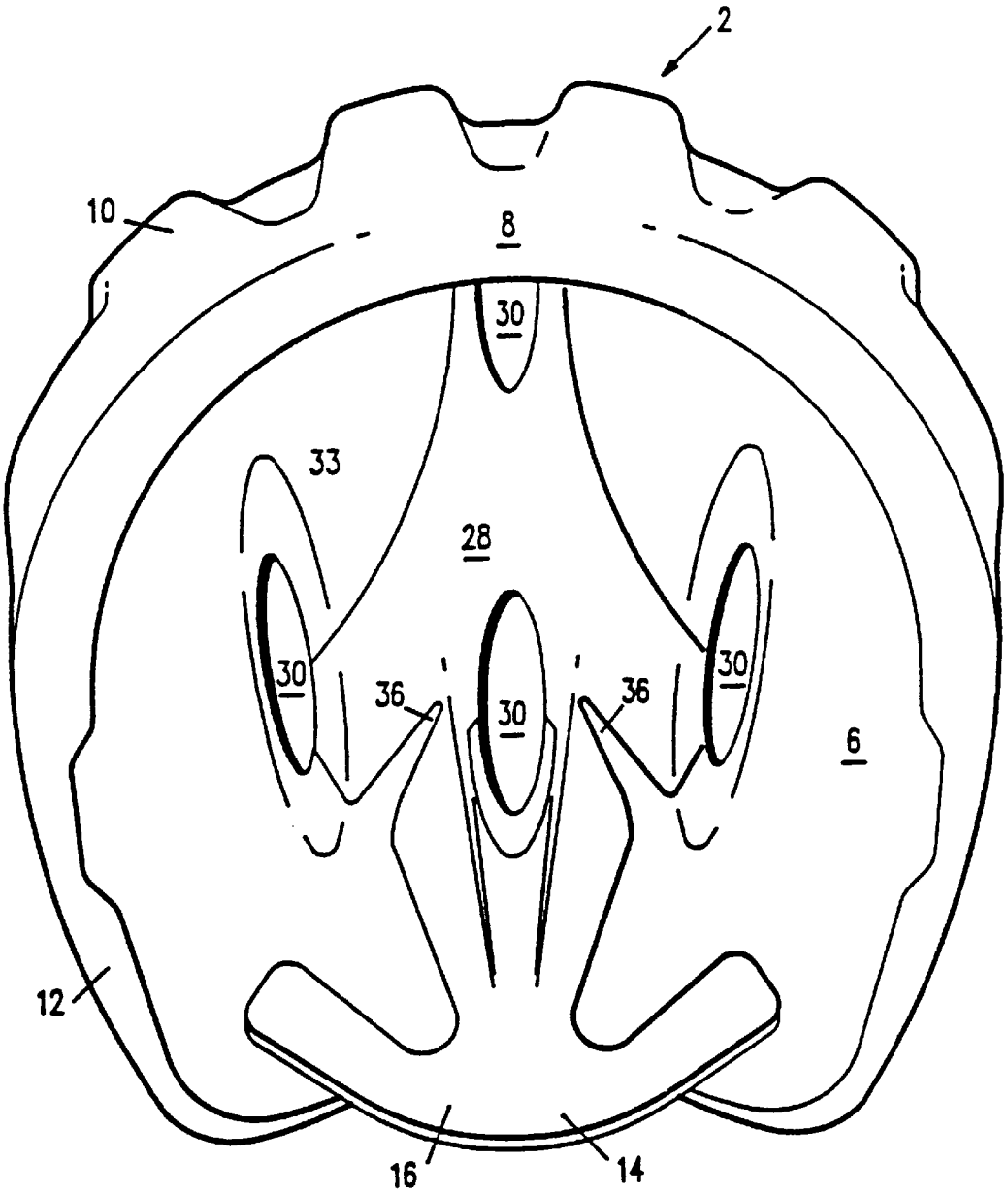
FIG. 3 is a lower frontal view showing the articulated member up inside the main shell in an alternative embodiment.

In the general embodiment, as shown in FIG. 2, the proximal end 28 of the articulated member 14 is forked so that it can be securely mounted to the interior 6 of the main shell 2 without interfering with the air flow through the air vents 30. Both tines 32 of proximal end 28 of articulated member 14 are attached to the interior 6 of the main shell 2 with fasteners or adhesive. Air vents 30 in the main shell 2 can be utilized to secure complementary tabs 33 on the articulated member 14, as shown in FIG. 3.

Figure 4:
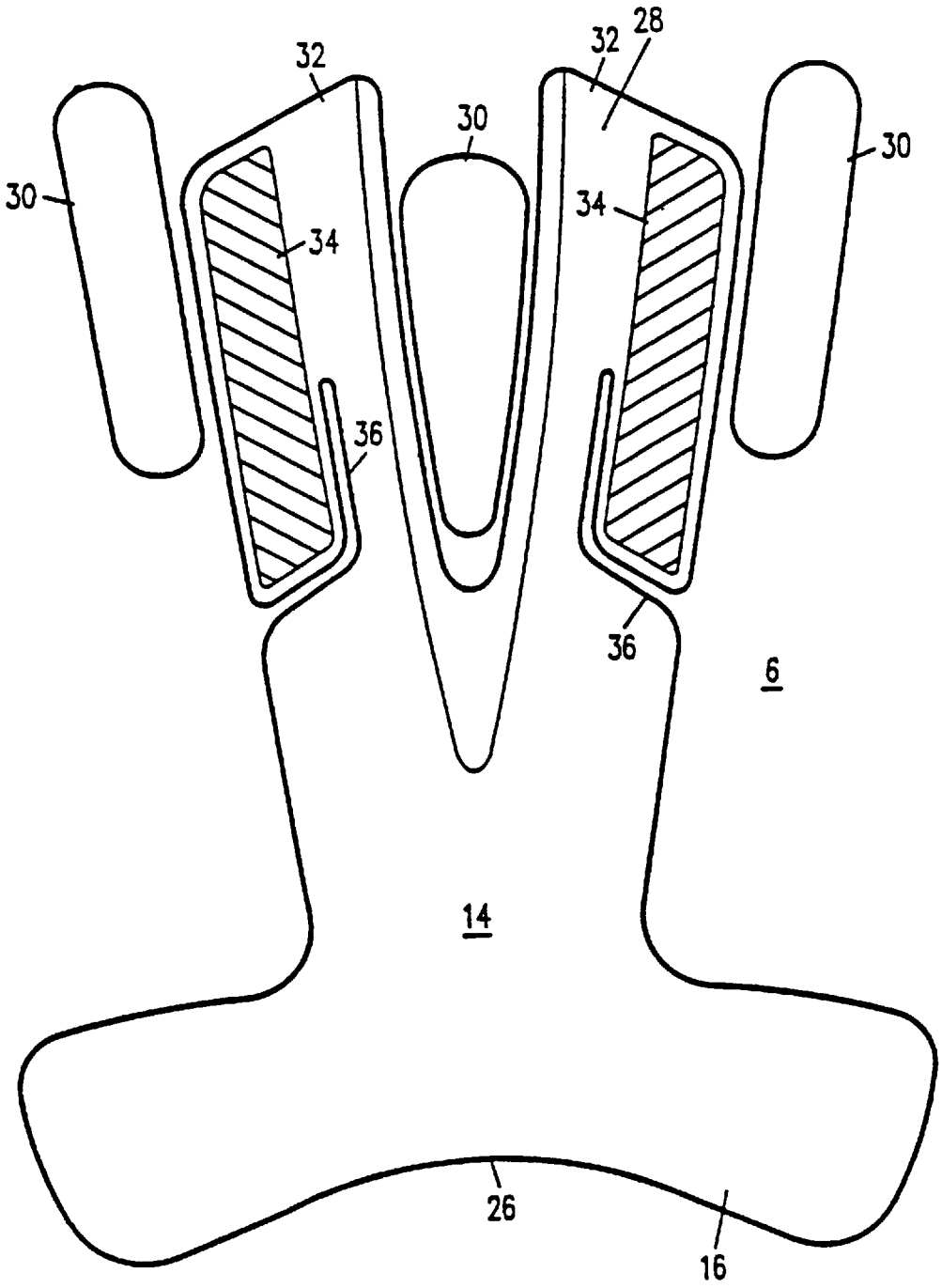
FIG. 4 is an enlarged, partial bottom view showing the articulated member in an alternative embodiment.

In an alternative embodiment shown in FIG. 4, the proximal end 28 of articulated member 14 is attached to the main shell 2 with an adhesive tape 34. Adhesive tapes offer excellent bonding strength when in tension, but are susceptible to peeling off when force is concentrated on one corner or edge. Reliefs 36, which are elongated cutouts in the articulated member 14, are provided in the proximal end 28 of the articulated member 14 to more centrally locate the force which is applied to the adhesive tape 34 when the articulated member 14 is flexed. This arrangement more evenly distributes the forces that would tend to separate the articulated member 14 from the main shell 2. Without the reliefs 36, articulated member 14 might be peeled off the main shell 2 by pushing the articulated member 14 forward, or from cycling back and forth due to prolonged use. The reliefs 36, however, ensure that the articulated member 14 remains adhered to the main shell 2 because the adhesive tape 34 is exposed to mostly tensile stress and low peel stress.

As shown in FIG. 1, an alternative embodiment can include the ability to adjust articulated member 14 in the direction of arrow B. The articulated member 14 can be slidably mounted to main shell 2 to allow the position of the member to be adjusted to a particular wearer's head. Several concepts to allow sliding movement and releasably locking in position are illustrated in FIGS. 9 through 14.

Figure 9B:
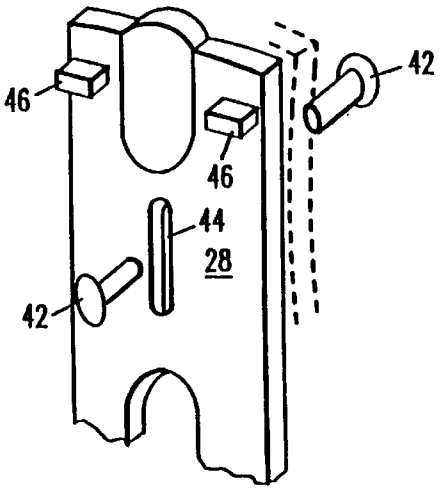
FIGS. 9*a* and 9*b* are perspective views showing a sliding adjustment and locking feature for the articulated member of an alternative embodiment.
Figure 9A:
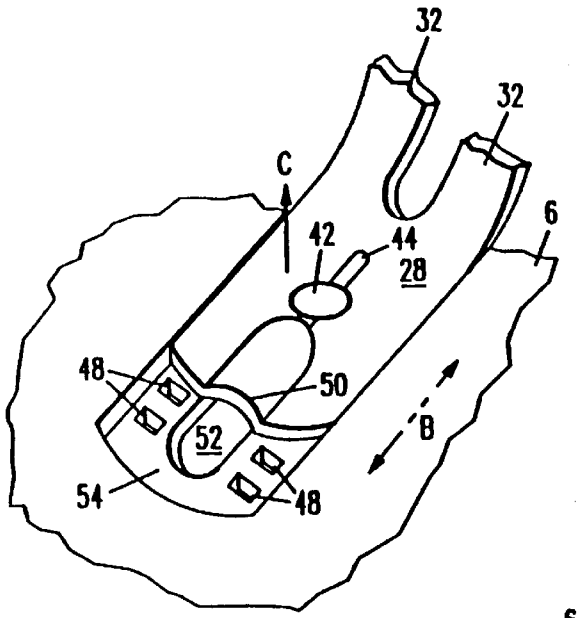

FIGS. 9*a* and 9*b* show on alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

A pair of tabs 46 protrude from proximal end 28 and each tab 46 engages a notch 48 to prevent the proximal end 28 from sliding. Two rows of notches 48 are provided, spaced laterally apart to accommodate the spacing of the two tabs. The notches 48 are spaced longitudinally, to provide alternative locking positions as the proximal end 28 is adjusted by sliding longitudinally. To allow the proximal end 28 to slide, the wearer is able to flex the proximal end 28 away from the main shell 2 in the direction of arrow C to momentarily disengage tabs 46 from notches 48. Once the proximal end 28 is slid in the direction of arrow B to a new position and released, the resilient force of the flexed proximal end 28 allows tabs 46 to engage with a new pair of notches 48.

Projection 50 in the proximal end 28 and hollow 52 in the interior surface 6 facilitate the wearer's ability to grasp the proximal end 28 for easy adjustment. The proximal end 28 can be located in a recess 54 in the interior surface 6 to provide greater comfort to the wearer and to longitudinally guide the proximal end 28 during adjustment.

Figure 10:
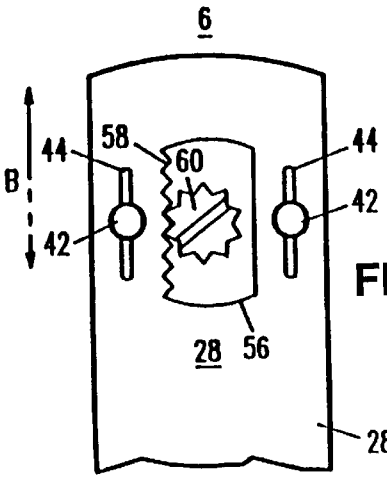
FIG. 10 is a perspective view showing a sliding adjustment and locking feature for the articulated member of an alternative embodiment.

FIG. 10 shows another alternative embodiment for adjusting the position of the articulated member 14. Proximal end 28 is slidably attached to the interior surface 6 with a pair of suitable fasteners 42, such as rivets, screw or split, plastic, flanged posts. Fasteners 42 passes through longitudinal slots 44 in the proximal end 28, thereby retaining the articulated member 14 on the main shell 2 while allowing it to slide in the longitudinal direction shown by arrow B.

A cutout 56 is provided in the proximal end 28 with a rack of teeth 58 located along an edge of cutout 56, having teeth spaced in a longitudinal direction. A pinion 60 is rotably mounted to the interior surface 6 within the cutout 56 such that it engages the rack of teeth 58. Pinion 60 can be rotated with a screwdriver, coin or the like to drive the proximal end 28 in a longitudinal direction.

Once adjusted, the proximal end 28 can be held in place by friction between the pinion 60 and interior surface 6 and/or friction between proximal end 28 and interior surface 6. Alternatively, the proximal end 28 can be locked down by tightening screw fasteners 42 after adjustment.

Figure 11:
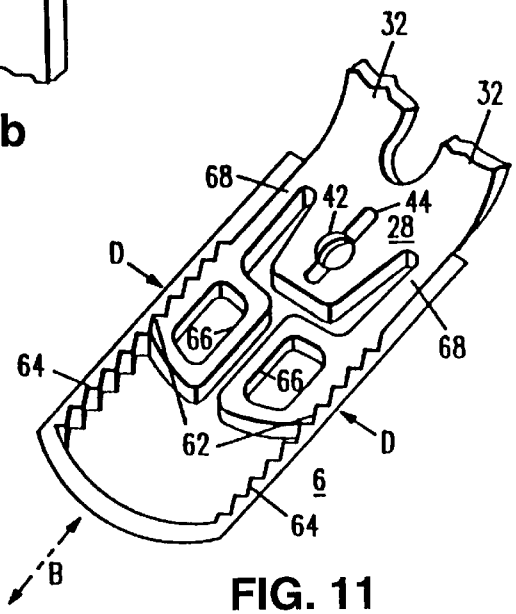
FIG. 11 is a perspective view showing a sliding adjustment and locking feature for the articulated member of an alternative embodiment.

FIG. 11 shows yet another alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

Opposite sides of proximal end 28 are fitted with teeth 62 spaced in a longitudinal direction. Each of the two sets of teeth 62 engages a complementary rack of teeth 64 attached to the interior surface 6 of the main shell 2 to releasably prevent the proximal end 28 from moving. A pair of finger holes 66 and a pair of flexures 68 are both incorporated into the opposite sides of proximal end 28 for allowing the wearer to flex the two sets of teeth 62 inwardly towards each, as shown by arrows D, and out of engagement with the racks of teeth 64. In this manner, the wearer can slide the proximal end 28 longitudinally, as shown by arrow B. When inward pressure is released from the finger holes 66, flexures 68 urge teeth 62 outwardly back into engagement with racks of teeth 64, thereby locking the articulated member 14 into position after adjustment.

Figure 12B:
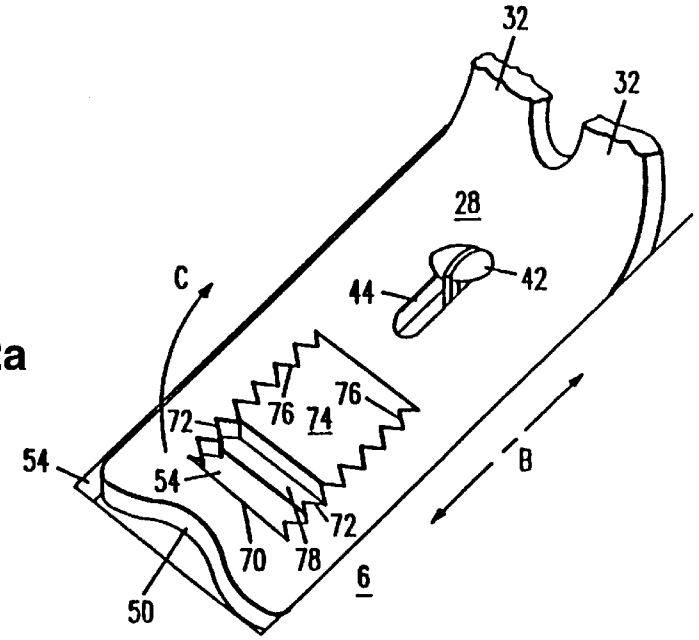
FIGS. 12*a* and 12*b* are perspective views showing a sliding adjustment and locking feature for the articulated member of an alternative embodiment.
Figure 12A:
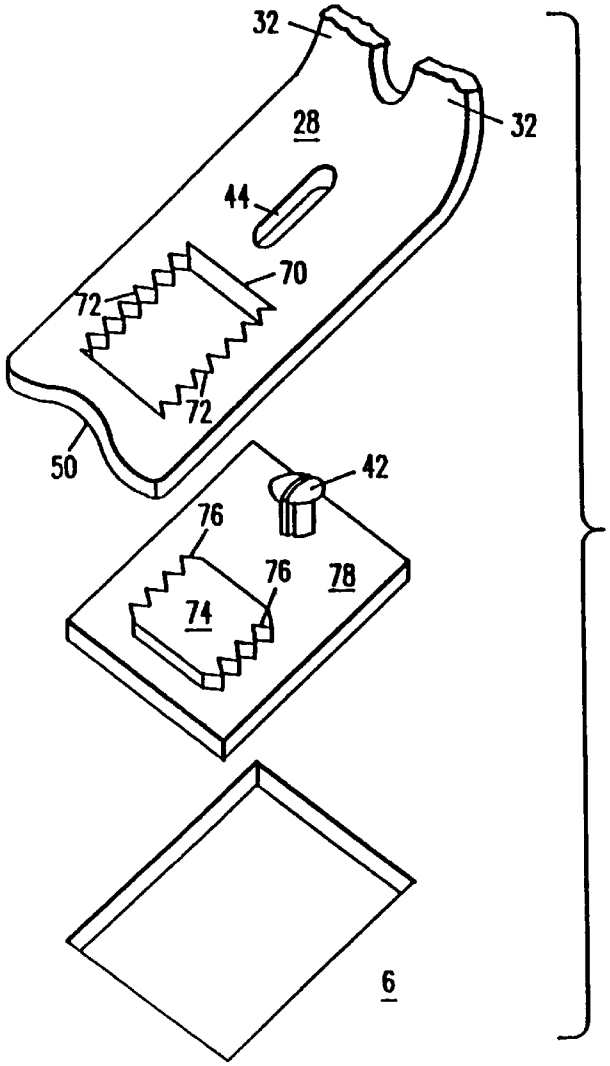

FIGS. 12*a* and 12*b* show yet another alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

A cutout 70 is provided through proximal end 28, having opposite sides formed by two racks of teeth 72, the teeth being spaced in a longitudinal direction. A complementary shaped, raised portion 74 is provided on the interior surface 6, partially filling cutout 70. Raised portion 74 is provided with teeth 76 on opposite sides for engagement with the two racks of teeth 72.

The raised portion has a longitudinal length that is shorter than that of cutout 70, so that the proximal end 28 may be alternatively adjusted and locked into a plurality of positions with respect to the main shell 2. To make such an adjustment, the wearer grasps the proximal end 28 at projection 50 and resiliently flexes the proximal end 28 away from interior surface 6, as shown by arrow C in FIG. 12*b*. This disengages the two racks of teeth 72 from teeth 76 and allows the wearer to move the proximal end 28 longitudinally, as shown by arrow B. When the projection 50 on the proximal end 28 is released after adjustment, a different portion of the two racks of teeth 72 are resiliently urged into engagement with teeth 76 on raised portion 74.

The proximal end 28 can be located in a recess 54 in the interior surface 6, as shown in FIG. 12*b*, to provide greater comfort to the wearer and to longitudinally guide the proximal end 28 during adjustment. Also, raised portion 74 and fastener 42 can be formed on a single plate 78 which is recessed when mounted on interior surface 6, as shown in FIG. 12*a* (or further recessed if used in conjunction with recess 54 in FIG. 12*b*).

Figure 13A:
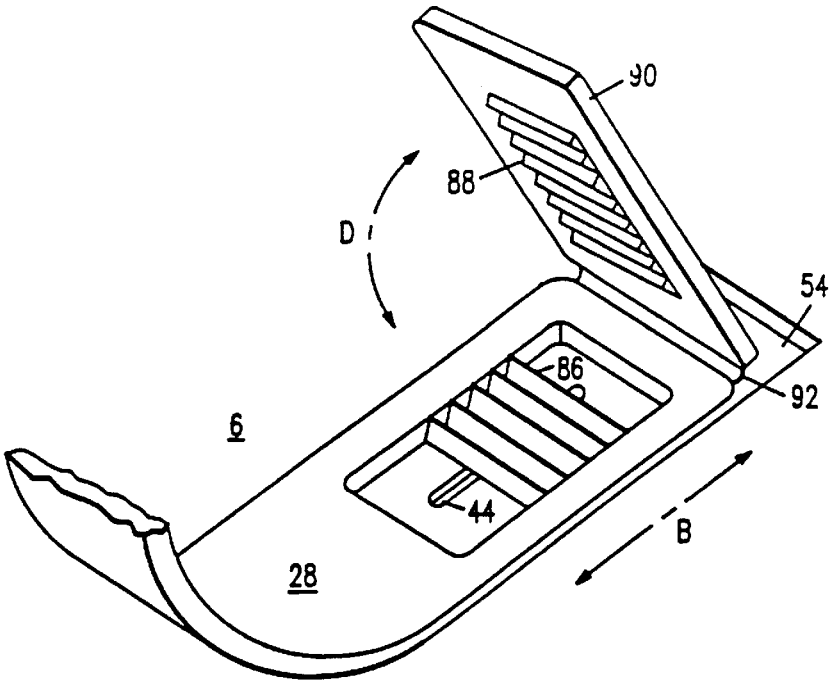
FIGS. 13*a* and 13*b* are perspective views showing a sliding adjustment and locking feature for the articulated member of an alternative embodiment.
Figure 13B:
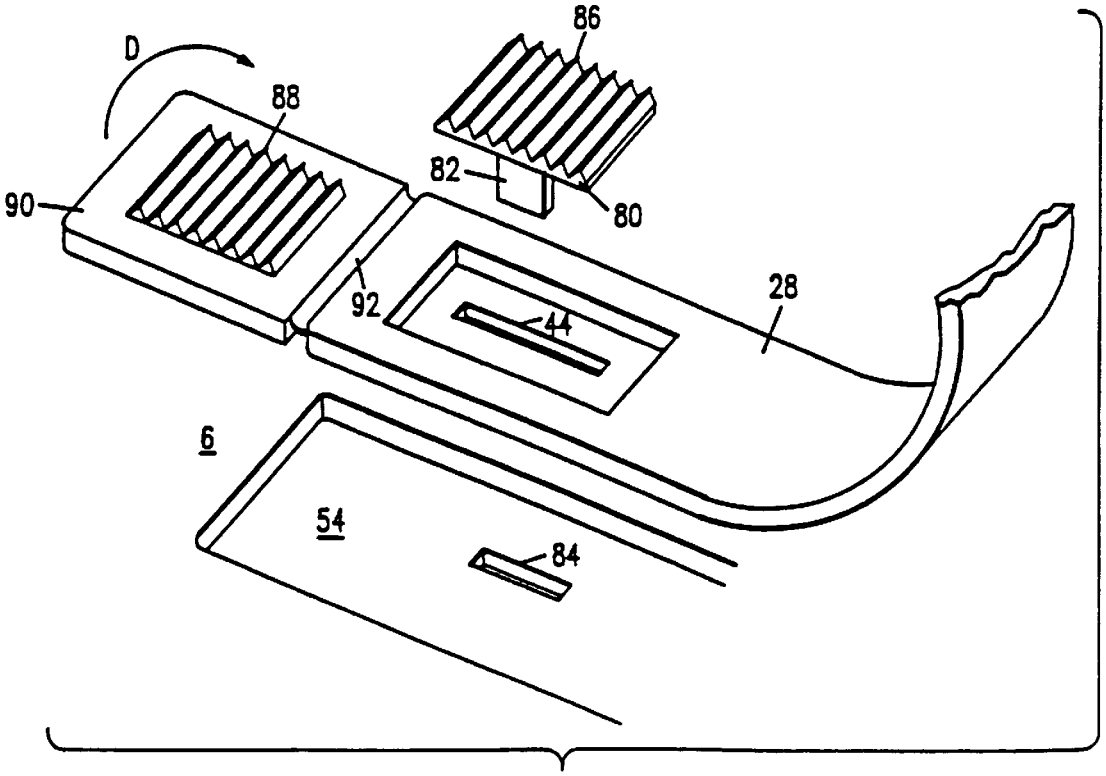

FIGS. 13*a* and 13*b* show yet another alternative embodiment for adjusting the position of the articulated member 14. Proximal end 28 is slidably attached to the interior surface 6 with a plate 80 and post 82 arrangement. Post 82 depends from plate 80 and passes through longitudinal slot 44 in the proximal end 28, and is received in slit 84 to attach the plate 80 to the interior surface 6, thereby retaining the articulated member 14 on the main shell 2 while allowing it to slide in the longitudinal direction shown by arrow B.

A plurality of ridges 86 are formed on plate 80 opposite post 82. A complementary set of ridges 88 is formed in flap 90, which is hingedly connected to proximal end 28 by a "living hinge" 92. Flap 90 may be folded back over onto proximal end 28, as shown by arrow D, and snapped into place, thereby engaging ridges 86 with ridges 88 and preventing proximal end 28 from movement. Adjustment is accomplished by unsnapping flap 90 to disengage ridges 88 from ridges 86, longitudinally sliding proximal end 28 to a new position, and snapping flap 90 back into position so that ridges 88 re-engage ridges 86.

Figure 14A:
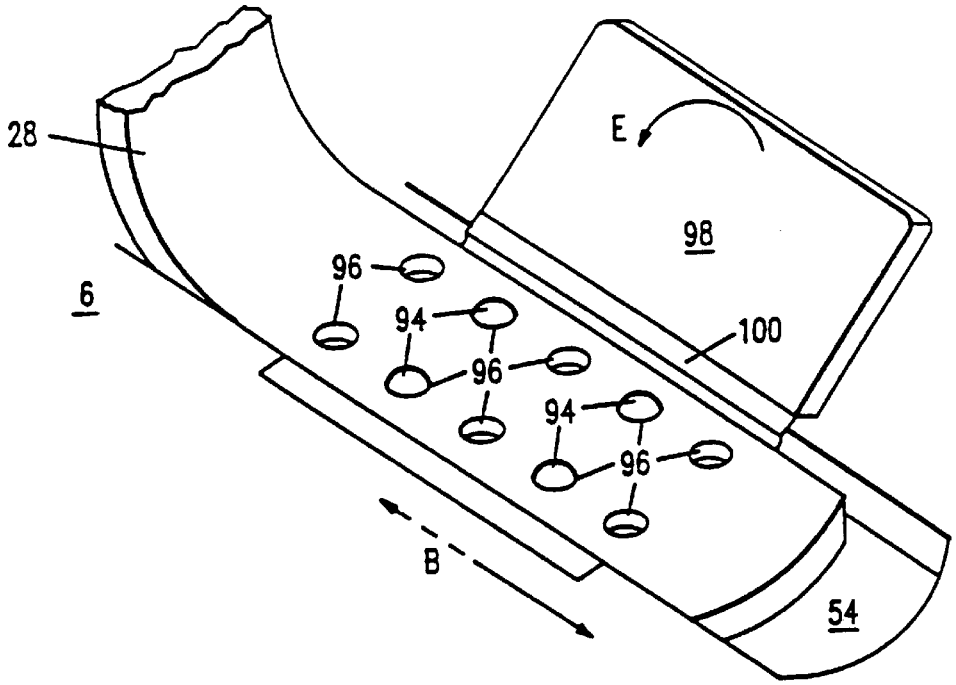
FIGS. 14*a* and 14*b* are perspective views showing a sliding adjustment and locking feature for the articulated member of an alternative embodiment.

FIG. 14*a* shows yet another alternative embodiment for adjusting the position of the articulated member 14. Two pairs of laterally spaced posts 94 are spaced longitudinally apart on interior surface 6. A plurality of pairs of mating holes 96 are longitudinally spaced along the proximal end 28 and two pairs of holes 96 at one time receive the two pairs of posts 94 to prevent the proximal end from moving longitudinally. Flap 98 is hingedly connected to interior surface 6 by living hinge 100, and snaps over proximal end 28 to secure it on posts 94, as shown by arrow E. Adjustment is accomplished in a fashion similar to that described above for previous embodiments.

Figure 14B:
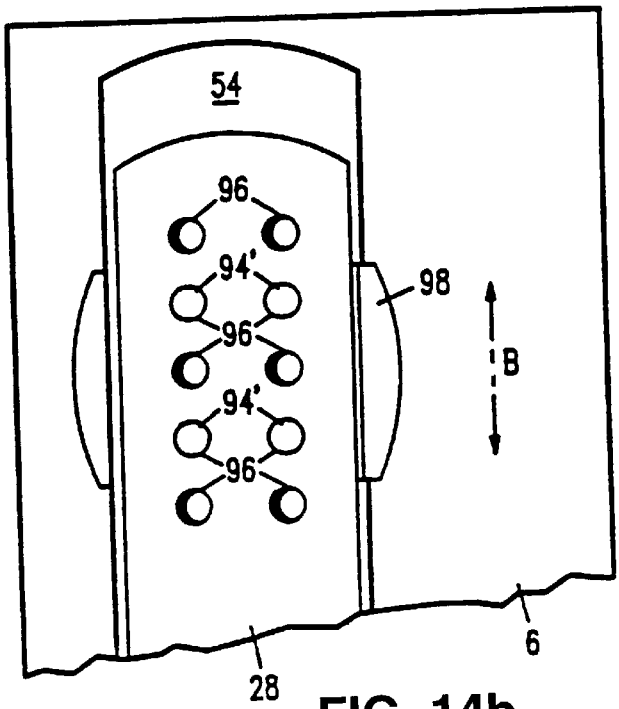

FIG. 14*b* shows one more alternative embodiment for adjusting the position of the articulated member 14. This embodiment is similar to that of FIG. 14*a*, but does not have a hingedly connected flap. Proximal end 28 is retained by posts 94', which have larger diameters at their distal ends than at their bases or than the diameters of the holes 96, thereby retaining proximal end 28 between the distal ends of posts 94 and the interior surface 6. This allows proximal end 28 of articulated member 14 to be unsnapped from posts 94', adjusted longitudinally, and snapped back onto the posts 94' with a different set of holes 96. Posts 94' can be formed on a plate 98, which is attached to main shell 2.

Figure 16:
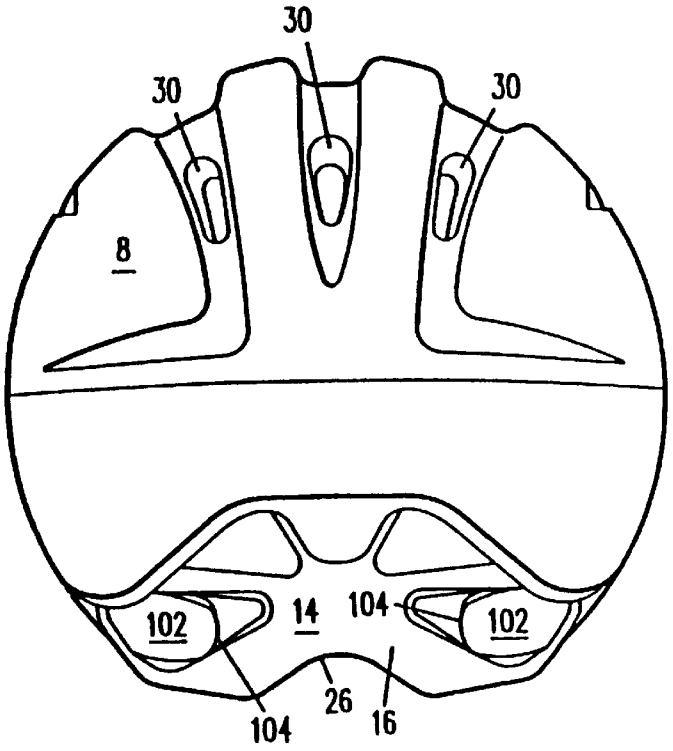
FIG. 16 is a rear elevation view showing the preferred embodiment of the inventive helmet.
Figure 15:
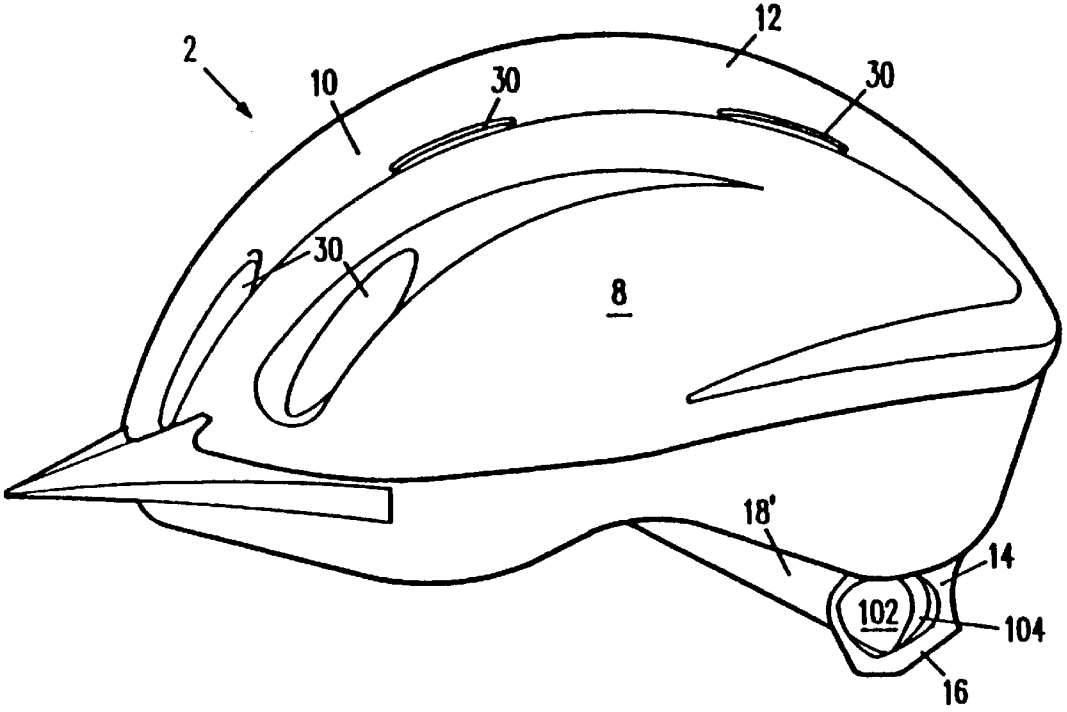
FIG. 15 is a side elevation view showing the preferred embodiment of the inventive helmet.
Figure 17B:
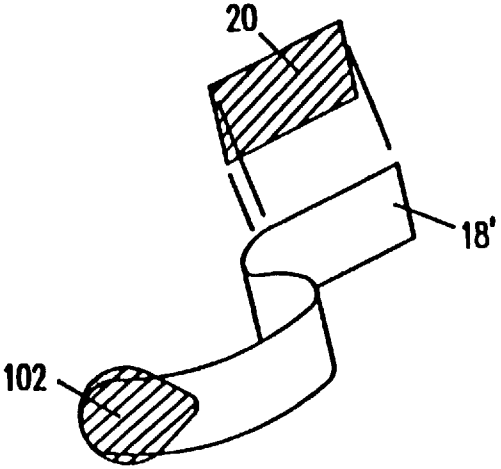
FIG. 17*b* illustrates attachment patches 20 of the preferred embodiment of FIGS. 15, 16 and 17*a*.
Figure 17A:
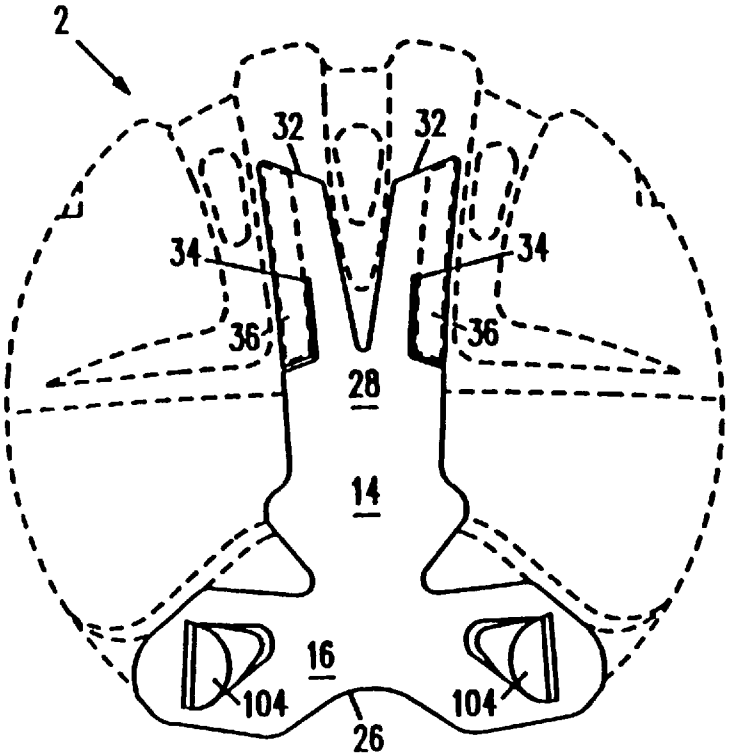
FIG. 17*a* is a rear elevation view showing the preferred embodiment of the articulated member with an underlaid rear view of a helmet to which the articulated member could be attached.

The general and alternate embodiments described above and shown in FIGS. 1 through 14 illustrate the general concept of the present invention. The preferred embodiment, as shown in FIGS. 15 through 17, is the intended design as it is envisioned for production, and operates substantially in an identical manner.

In the preferred embodiment, two straps 18' are used to connect the articulated member 14 to the main shell 2. Each strap 18' is connected to the articulated member 14 with a strap connector 102. Strap connectors 102 are plastic tabs that are ultrasonically welded onto one end of elastic straps 18', and fit into and are retained by pockets 104 in the articulated member 14. The opposite ends of straps 18' are adjustably attached to patches 20 of VELCRO® hook and loop type fasteners glued inside the main shell 2. In the preferred embodiment, all of the force exerted by the articulated member 14 against the wearer's head is generated by the stretching of straps 18'. In the relaxed position when not being worn and with the straps 18' removed, the articulated member 14 rests against the inside of the rear of the helmet.

In another alternative embodiment shown in FIGS. 18*a* through 20, the articulated member 14 may be attached to the inside of the main shell 2 with a snap-in arrangement. This arrangement reduces manufacturing costs by eliminating the need for adhesive tape and requires very little labor to snap the articulated member 14 in place.

Figure 18B:
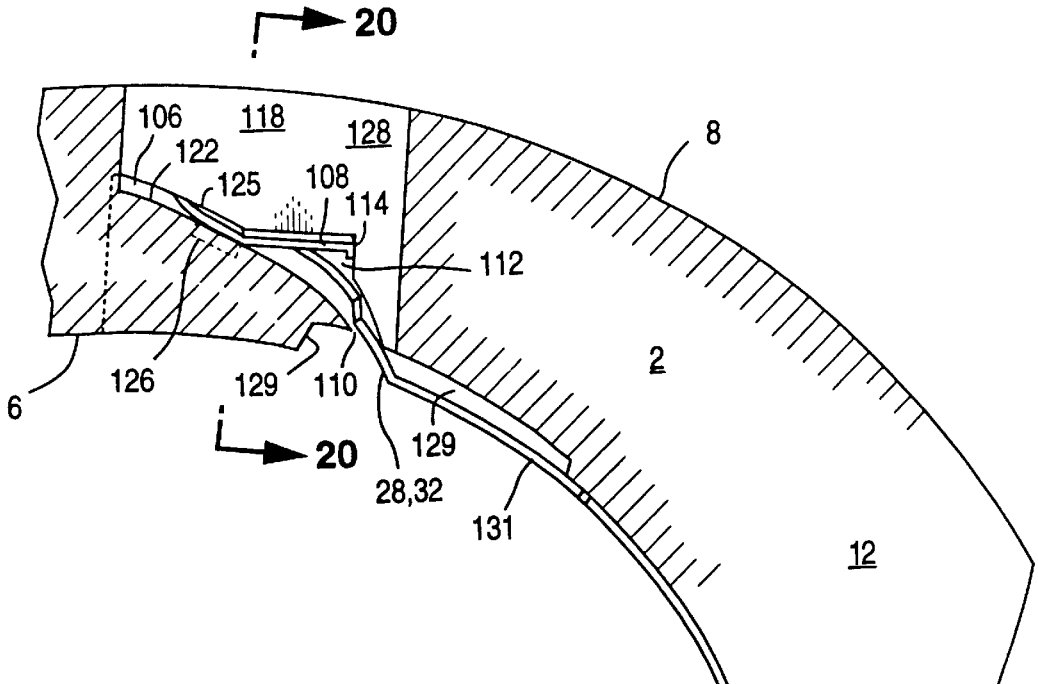
FIG. 18*b* is a fragmentary side elevational view showing the arcuate passage and the dies used to make it.

Referring to FIG. 18*b*, an arcuate passage 106 is shown in the main shell 2. A single arcuate passage 106 can be used if the proximal end 28 of the articulated member 14 has only one end. However, when the proximal end 28 has two tines 32, as shown in FIG. 18*d*, two arcuate passages 106 are used, with the passages being identical mirror images of each other. For clarity, only one passage 106 and one tine 32 are shown in FIGS. 18*a*, 18*b*, 18*c*, 19 and 20. Preferably, passage 106 is located toward the forward portion of the rear half 12 of main shell 2, and curves upward towards the front half 10. Passage 106 communicates with the interior of the helmet through slit 110.

A resiliently flexible barb 108 is formed on each tine 32. Barb 108 resiliently flattens down when the proximal end 28 of the articulated member 14 is inserted into arcuate passage 106 through slit 110. Barb 108 springs back to its original rearward and upward protruding direction when it encounters pocket 112, which is above and communicates with the arcuate passage 106. Barb 108 abuts the rear surface 114 of pocket 112 to permanently retain the proximal end 28 in the main shell 2. An access hole (not shown) connecting the pocket 112 with the exterior surface 8 could be added if it were desired to make the articulated member 14 removable by pressing barb 108 down.

Figure 18A:
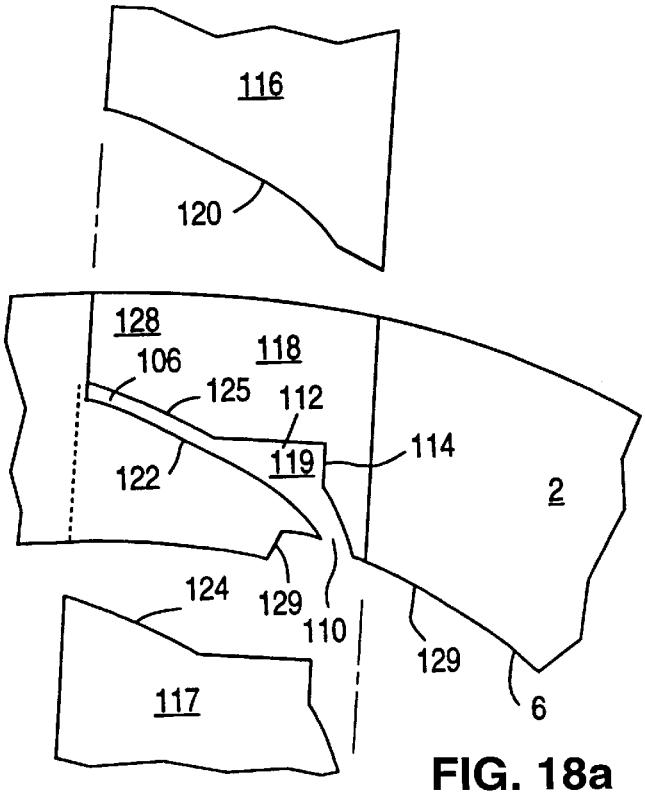
FIG. 18*a* is a side elevational cross-section view showing the articulated member in the arcuate passage.
Figure 18D:
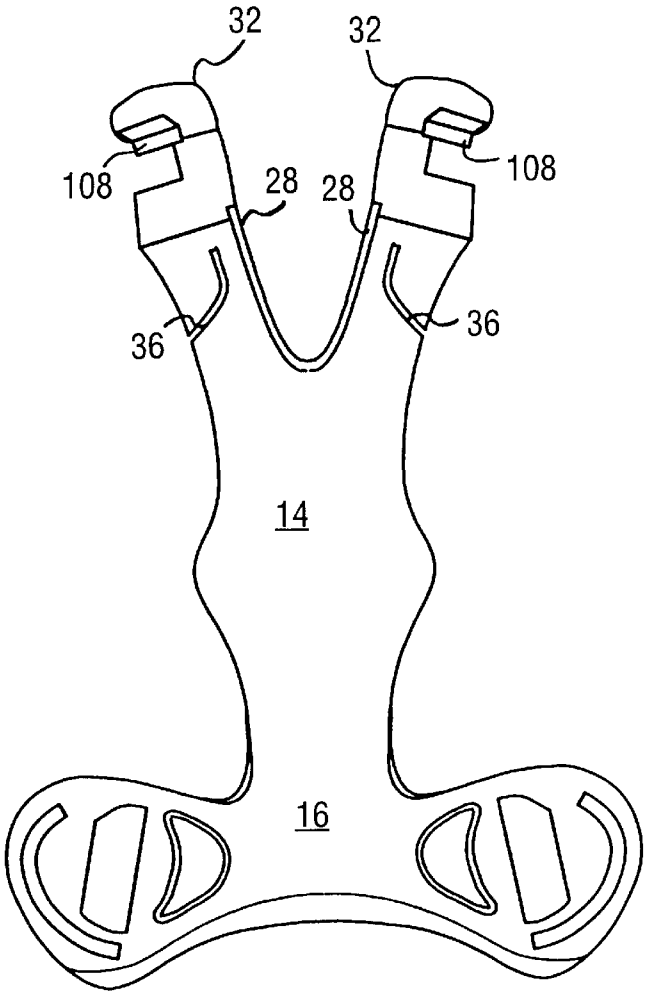
FIG. 18*d* is a rear elevational view of the articulated member shown in FIG. 18*c*.
Figure 18C:
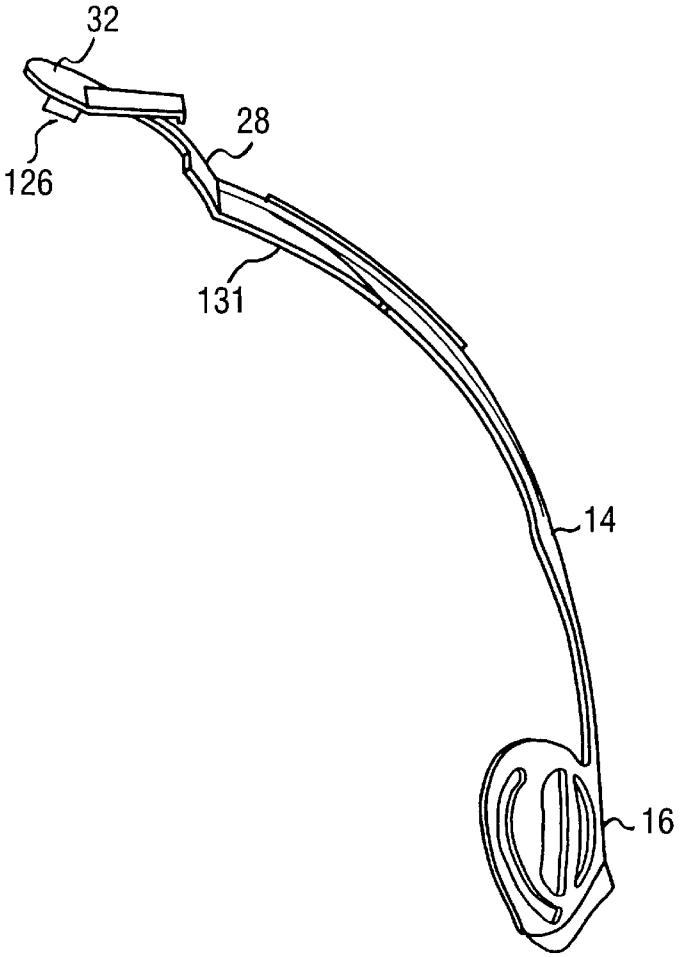
FIG. 18*c* is a side elevational view of the articulated member shown in FIG. 18*b*.
Figure 19:
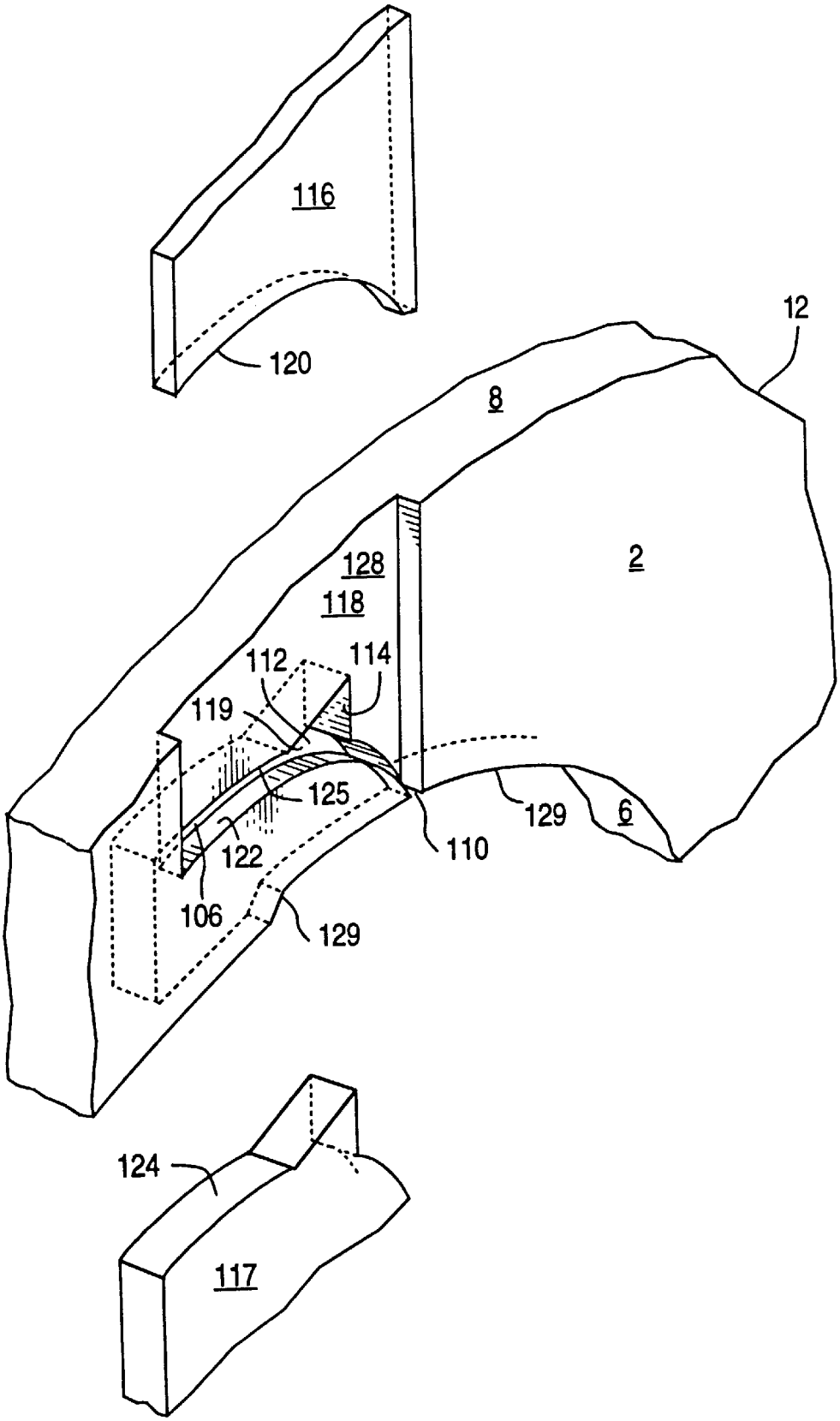
FIG. 19 is a fragmentary perspective view of FIG. 18.
Figure 20:
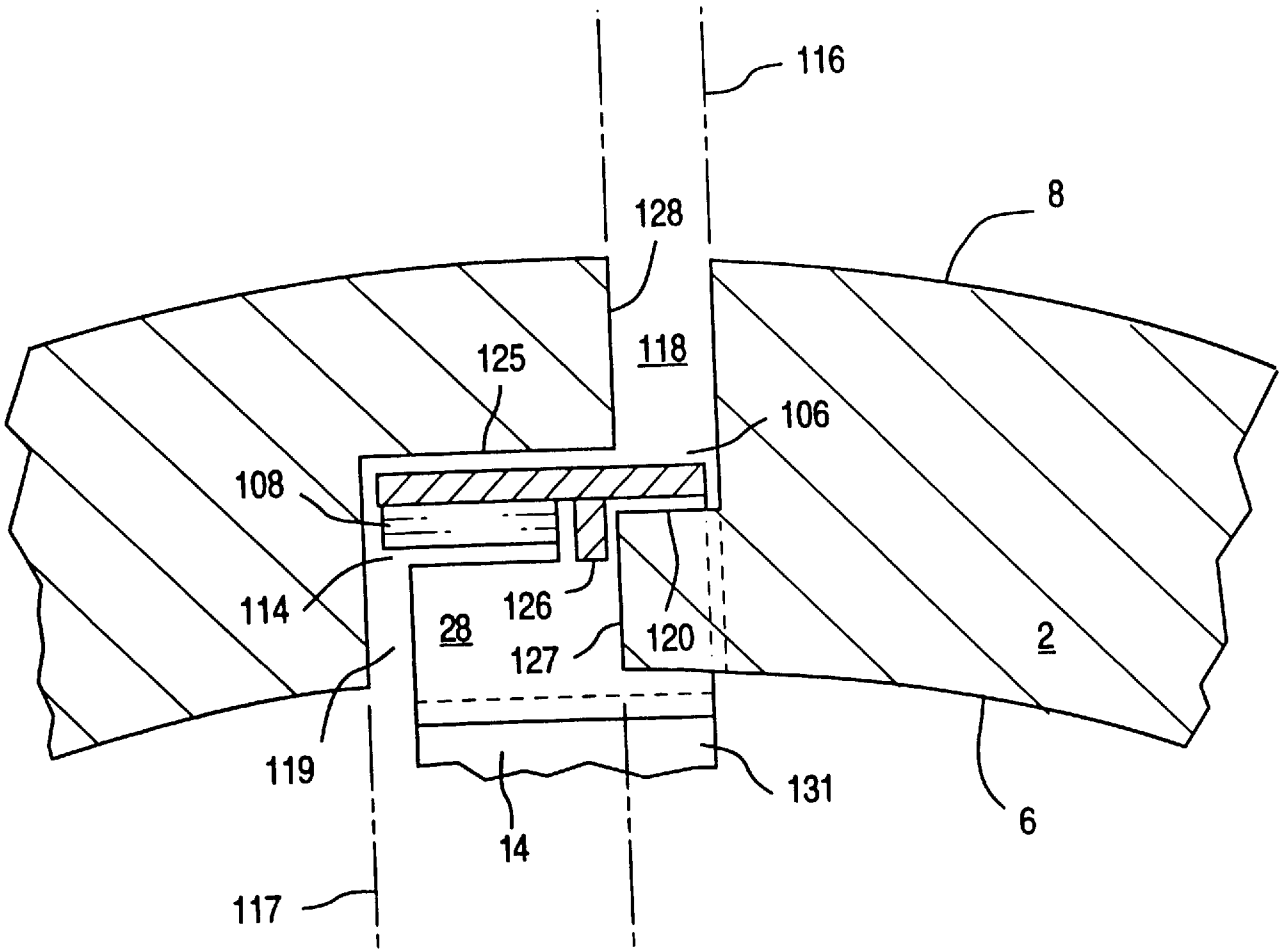
FIG. 20 is a front elevational cross-section view taken along line 20—20 in FIG. 18*b*, showing the articulated member in the arcuate passage.

Referring to FIGS. 18*a* and 19 and 20, main shell 2 is typically formed by a molding process, with a lower mold half (not shown) forming the interior surface 6 of the helmet, and a separable upper mold half (not shown) forming the exterior surface 8. Because of this molding process, the arcuate passage 106 cannot be directly formed if main shell 2 is to be fabricated in a single molded piece. To get around these molding constraints, arcuate passage 106 can be formed by utilizing an upper die 116 attached to the upper mold half, and a lower die 117 attached to the lower mold half. The upper die 116 creates an upper void 118 during the molding process, while lower die 117 creates a lower void 119. The upper die 116 and lower die 117 are offset so that when the two mold halves come together, the upper die 116 and the lower die 117 are side by side and overlap slightly. The region of die overlap forms the arcuate passage 106 and is greater than the thickness of the proximal end 28 so as to accommodate it. The total width of the upper die 116 and the lower die 117 when side by side is greater than the width of the proximal end 28. The bottom 120 of upper die 116 forms an arcuate surface 122 which partially defines the bottom of the arcuate passage 106, and also forms part of slit 110 through the interior surface 6. The top 124 of lower die 117 forms a complementary arcuate surface 125 which partially defines the top of arcuate passage 106, and also forms pocket 112.

Referring to FIGS. 18*b* and 20, a downward protruding tab 126 can be formed on the proximal end 28 to help stabilize the articulated member 14 from lateral movement. Tab 126 contacts the inside surface 127 of the lower void 119 to prevent the proximal end from moving to the right. For added safety from possible contact with the top of the wearer's head, tab 126 can alternatively protrude upwardly (not shown) to contact the inside surface 128 of upper void 118, or the tab can be partially punched from a cutout in the proximal end 28 (not shown) so as to be able to be flexed back into the cutout during a severe impact. For added stability, tabs can protrude both upwardly and downward (not shown).

Referring to FIGS. 18*a*, 18*b* and 19, a recess 129 is preferably formed on the interior surface 6 of the main shell 2 behind slit 110 to accommodate the articulated member 14 so that it is flush with the interior surface 6. This allows a substantially continuous arc to be formed by the bottom surface 131 of the articulated member 14 and the interior surface 6 forward of the slit 110, thereby providing greater comfort for the wearer.

Figure 21:
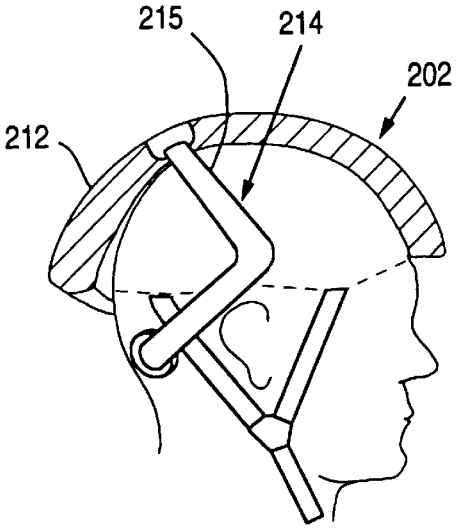
FIG. 21 is a side elevational view, partially in section, similar to FIG. 1 but showing another alternative embodiment of the present invention.
Figure 22:
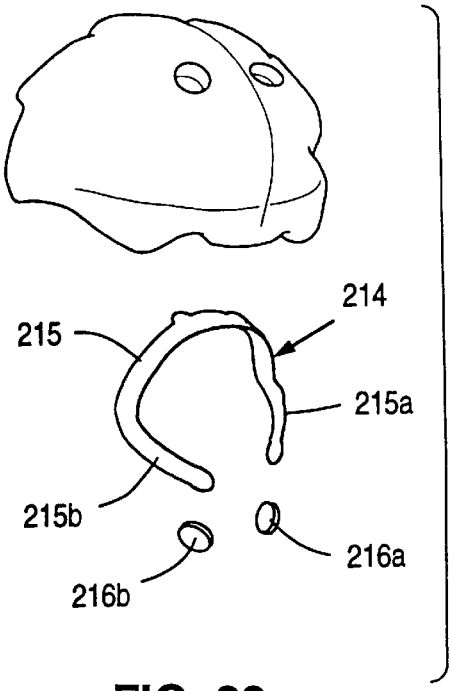
FIG. 22 is an exploded rear perspective view similar to FIG. 5 but showing the embodiment of FIG. 21.

Referring now to FIGS. 21 and 22, there is shown an alternative embodiment of the present invention wherein the articulated member 214 has a laterally arched central portion 215 which is joined at its midpoint to the rear half 112 of the helmet main shell 202. At the ends of the arched central portion 215 are a pair of flex-arm extensions 215*a* and 215*b* which have cushion pads 216*a* and 216*b* at their distal ends for engaging the inwardly curved portion of the posterior of the head of the wearer. The articulated member 214 including both its laterally arched central portion 215 and its flexure extensions 215*a* and 215*b* can resiliently flex away from the head of a wearer when the wearer places the helmet on his/her head, and once the helmet is placed on the wearer's head, these members provide the resilient pressure against the inwardly curved portion of the posterior of the wearer's head. As in certain other embodiments the connection of the laterally arched central portion to 15 of the articulated member is forward of the back of the neck of the wearer. In these figures, the chin strap is shown in its ultimate position when the helmet is in place, and the chin strap is not attached to the articulated member.

Figure 23:
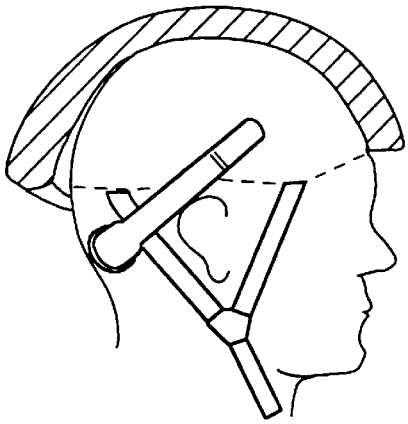
FIGS. 23 and 24 are views similar to FIGS. 21 and 22, but illustrating still another embodiment of the present invention.
Figure 24:
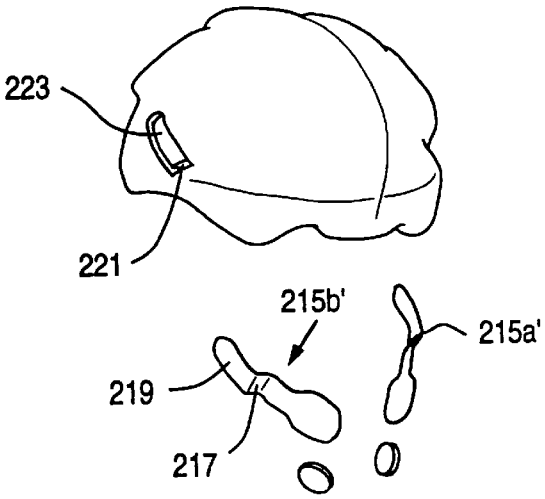

Referring now to FIGS. 23 and 24, there is shown still another alternative embodiment of the present invention similar to the embodiment shown in FIGS. 21 and 22 except that the flex arm extensions 215*a'* and 215*b*' are attached directly to the sides of the helmet such as by having a bent section 217 which fits through a slot opening 221 in the helmet so that the end 219 is captured recess 223. The flex arms 215*a*' and 215*b*' provide similar flexure against the inwardly curved portion on the posterior of the head of the wearer, except that the mounting point of the proximal ends of the flex arms 215*a*' and 215*b*' are at the sides of the helmet at the slot opening 217 and recess 223 rather than at the top of the helmet.

Figure 25A:
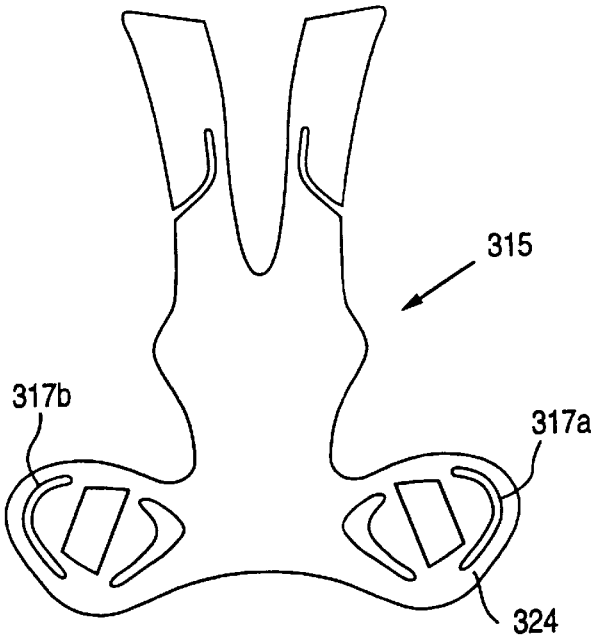
FIGS. 25(*a*) and 25(*b*) are plan views of the articulated member and padding strap of still another embodiment of the present invention.
Figure 26:
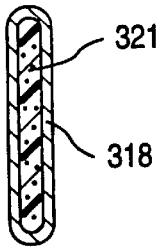
FIG. 26 is a cross-sectional view of a portion of the structure shown in FIG. 25(*b*) taken along the line F—F in the direction of the arrows.
Figure 27:
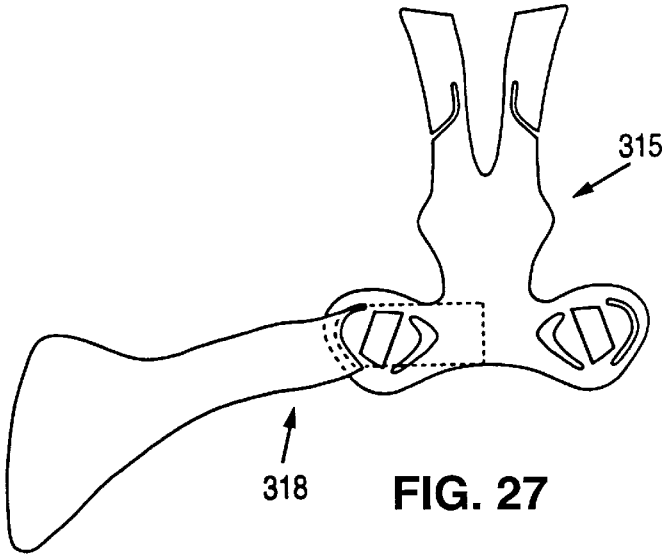
FIG. 27 is a plan view of the articulated member of FIG. 25(*a*) and one-half of the padded strap of FIG. 25(*b*) assembled for insertion into a helmet.
Figure 25B:
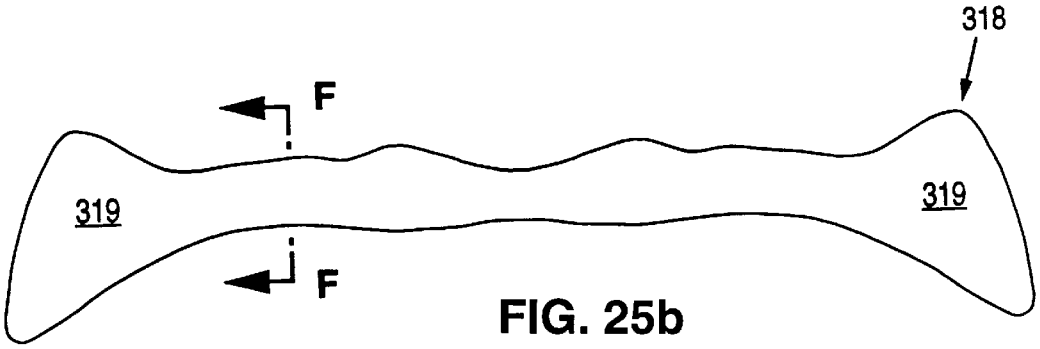

Referring now to FIGS. 25, 26 and 27 there is disclosed still another alternative embodiment of the present invention wherein the attachment strap is padded and provides the padding between the helmet shell and the head of the wearer. The articulated member 315 is similar to the articulated member 14 illustrated in FIGS. 15–17 but with the additional provision of arcuate slots 317*a* and 317*b* near the outer ends of the outer binds 324 on the "T" at the distal end of the articulated member 315. An elongated wraparound padded strap 318 is slidably passed through the slots 317*a* and 317*b* so that the forward ends 219 thereof wrap around the side of the head of the wearer between the head of the wearer and the lower sides of the helmet shell for attachment to the helmet shell. In the preferred version of this embodiment and as shown in FIG. 26, the strap 318 is made with a brushed nylon outside surface that operates as a loop fastener material of the hook and loop type fastener type and surrounds foam padding 321 such as polyester foam of 1.5 pound density. The helmet includes patches of loop type fastening material such as the Velcro c hook type material 20 as shown in FIG. 17*b* and which is attached to the helmet shell along the interior sides. Thus, this strap 318 which has some elasticity helps provide the pressure for the articulated member 315 against the wearer's head and can be adjusted in length by positioning the ends 319 at different locations with respect to the hook-type fasten material within the helmet and at the same time provide the necessary padding between the wearer's head and the helmet shell itself.

It is to be understood that the present invention is not limited to the sole embodiments described above and illustrated herein, but encompasses any and all variations falling within the scope of the appended claims.

What is claimed as the invention is:

1. A bicycle helmet comprising:

shell assembly substantially covering a top portion of a wearer's head and having opposite sides;

at least one articulated member depending from the shell assembly, the articulated member having a distal end;

resilient flex means for allowing the distal end of the articulated member to resiliently flex rearward when the helmet is donned to provide a resilient forward pressure against an inwardly curved portion on the posterior of a wearer's head, thereby providing a more securely fitted helmet; and at least one elastically elongatable strap spanning between the articulated member and the opposite sides of the shell assembly for providing additional resilient forward pressure against an inwardly curved portion on the posterior of a wearer's head;

at least a portion of said elongated strap spanning between the articulated member and the opposite sides of the shell assemblies including foam padding attached thereto shaped to provide padding between the sides of the head of a wearer and said shell assembly said strap surrounding said foam padding and formed of loop material of a hook and loop type fastener.

2. A bicycle helmet according to claim 1, further comprising at least one inverted J-shaped member attached near the distal end of the articulated member for releasably and slidably captivating the elastically elongatable strap and preventing it from sliding upward along the articulated member.

3. A bicycle helmet comprising:

a shell assembly substantially covering a top portion of a wearer's head and having opposite sides;

at least one articulated member depending from the shell assembly, the articulated member having a distal end; and resilient flex means for allowing the distal end of the articulated member to resiliently flex rearward when the helmet is donned to provide a resilient forward pressure against an inwardly curved portion on the posterior of a wearer's head, thereby providing a more securely fitted helmet;

said articulated member having a proximal end, and said shell assembly having a front half, a rear half, an interior surface and an exterior surface, said proximal end of said articulated member being attached to the central top interior surface toward the front of the rear half of said shell assembly forward of the back of the neck of a wearer;

said proximal end of the articulated member being attached to said shell assembly by adhesive means, said articulated member having a middle portion connecting the distal end to the proximal end, said middle portion being partially separated from the proximal end by reliefs such that forces from the distal end are transmitted to a substantially central area of the proximal end, thereby reducing any peeling forces that would tend to separate the proximal end from the shell assembly.

4. A bicycle helmet comprising:

a shell assembly substantially covering a top portion of a wearer's head and having opposite sides;

at least one articulated member depending from the shell assembly, the articulated member having a distal end; and resilient flex means for allowing the distal end of the articulated member to resiliently flex rearward when the helmet is donned to provide a resilient forward pressure against an inwardly curved portion on the posterior of a wearer's head, thereby providing a more securely fitted helmet, said articulated member being shaped to curve up inside a plurality of air vents which pass through the shell assembly, thereby securing the articulated member from lateral and longitudinal movement.

5. A bicycle helmet comprising:

a shell assembly substantially covering a top portion of a wearer's head and having opposite sides;

at least one articulated member depending from the shell assembly, the articulated member having a distal end; and resilient flex means for allowing the distal end of the articulated member to resiliently flex rearward when the helmet is donned to provide a resilient forward pressure against an inwardly curved portion on the posterior of a wearer's head, thereby providing a more securely fitted helmet;

said articulated member being slidably attached to an interior surface of the shell assembly to allow a wearer to adjust the position of the articulated member relative to the shell assembly, the helmet further comprising releasable locking means for releasably locking the articulated member in a fixed position relative to the shell assembly after position adjustment.

6. A bicycle helmet according to claim 5, wherein the slidable attachment adjustment only shifts the location of the articulated member vertically relative to the nape of a wearer's neck, and not the level of resilient forward pressure against a wearer's neck.

7. A bicycle helmet according to claim 5, wherein the slidable attachment and releasable locking means comprise:

rivet means for slidably attaching a proximal end of the articulated member to the shell assembly, the rivet means passing through a hole in a portion of the shell assembly and through a longitudinal slot in the proximal end, thereby retaining the articulated member on the shell assembly while allowing it to slide longitudinally;

at least one tab protruding from the proximal end of the articulated member towards the shell assembly;

a plurality of complementary shaped and longitudinally spaced notches in the shell assembly for alternately engaging a tab to lock the position of the articulated member with respect to the shell assembly; and a resiliently flexible portion of the proximal end of the articulated member, thereby allowing a wearer to flex the proximal end away from the shell assembly for disengaging a tab from one of the notches and allowing the user to slide the tab and proximal end longitudinally for engagement with another notch.

8. A bicycle helmet according to claim 5, wherein the slidable attachment and releasable locking means comprise:

rivet means for slidably attaching a proximal end of the articulated member to the shell assembly, the rivet means passing through at least one hole in a portion of the shell assembly and through at least one longitudinal slot in the proximal end, thereby retaining the articulated member on the shell assembly while allowing it to slide longitudinally;

a rack of gear teeth aligned longitudinally on the proximal end;

a pinion rotably mounted on the shell assembly having complementary teeth for engaging the rack of gear teeth and for driving the articulated member longitudinally forward and back; and friction means for holding the articulated member in position when it is not being driven by the pinion.

9. A bicycle helmet according to claim 5, wherein the slidable attachment and releasable locking means comprise:

rivet means for slidably attaching a proximal end of the articulated member to the shell assembly, the rivet means passing through a hole in a portion of the shell assembly and through a longitudinal slot in the proximal end, thereby retaining the articulated member on the shell assembly while allowing it to slide longitudinally;

at least one rack of teeth located longitudinally on the shell assembly;

at least one complementary shaped tooth located on the proximal end for releasably engaging the rack of teeth and preventing the proximal end from sliding longitudinally;

at least one flexure incorporated on the proximal end for allowing the complementary shaped tooth to be disengaged from the rack when a pressure is applied; and grip means for allowing a wearer to grip the proximal end, apply a pressure to operate the flexure and disengage the complementary shaped tooth, and slide the proximal end longitudinally.

10. A bicycle helmet according to claim 5, wherein the slidable attachment and releasable locking means comprise:

rivet means for slidably attaching a proximal end of the articulated member to the shell assembly, the rivet means passing through a hole in a portion of the shell assembly and through a longitudinal slot in the proximal end, thereby retaining the articulated member on the shell assembly while allowing it to slide longitudinally;

a plurality of evenly spaced teeth arranged longitudinally on the proximal end of the articulated member;

a plurality of complementary shaped teeth arranged longitudinally on the shell assembly for alternately engaging the teeth on the proximal end to lock the position of the articulated member with respect to the shell assembly; and a resiliently flexible portion of the proximal end of the articulated member, thereby allowing a wearer to flex the proximal end away from the shell assembly for disengaging the teeth of the proximal end from the teeth of the shell assembly and allowing the user to slide the proximal end longitudinally for engagement with another set of teeth.

11. A bicycle helmet according to claim 5, wherein the slidable attachment and releasable locking means comprise:

a first set of evenly spaced ridges spaced along a longitudinal direction on a platform, the platform being connected on an opposite side to the shell assembly by a post passing through a longitudinal slot in a proximal end of the articulated member, the platform thereby retaining the proximal end between itself and the shell assembly while allowing the proximal end to slide longitudinally; and a second set of evenly spaced ridges for releasably engaging the first set, the second set located on an appendage hingedly connected to the proximal end of the articulated member, such that when the appendage is folded back over onto the proximal end the second set engages the first set to prevent the proximal end from sliding, and when the appendage is unfolded the second set disengages the first set and allows the proximal end to be slid to another engagement position.

12. A bicycle helmet according to claim 5, wherein the slidable attachment and releasable locking means comprise:

a first member;

a second member, one of the first and second members including at least one peg, and the other including a plurality of longitudinally spaced holes for alternately receiving a peg for adjustably locating and locking the first member longitudinally with the second member; and a flap hingedly connected to and folding over one of the first and second members and sandwiching the other member therebetween, the flap acting to secure at least one peg in a hole while folded over and allowing the at least one peg to be released when unfolded.

13. A bicycle helmet according to claim 12, wherein the at least one peg and the flap are located on the shell assembly and the longitudinally spaced holes are located on a proximal end of the articulated member.

14. A bicycle helmet according to claim 5, wherein the slidable attachment and releasable locking means comprise:

a plate embedded in the shell assembly with an exposed surface within a longitudinal recess on an interior surface of the helmet, the recess slidably receiving a proximal end of the articulated member;

at least one pair of laterally spaced posts with proximal ends attached to the exposed surface of the plate, the distal ends of the posts having a diameter larger than that of the proximal ends of the posts; and a plurality of pairs of laterally spaced holes, the pairs of holes arranged longitudinally along the proximal end of the articulated member for receiving the at least one pair of posts, the holes having diameters smaller than those of the distal ends of the posts to allow the articulated member to be snapped onto the posts and releasably retained thereby, the plurality of pairs of holes providing a plurality of adjustment positions for the articulated member with respect to shell assembly.

15. A bicycle helmet comprising:

a shell assembly substantially covering a top portion of a wearer's head and having opposite sides;

at least one articulated member depending from the shell assembly, the articulated member having a distal end; and resilient flex means for allowing the distal end of the articulated member to resiliently flex rearward when the helmet is donned to provide a resilient forward pressure against an inwardly curved portion on the posterior of a wearer's head, thereby providing a more securely fitted helmet;

said articulated member including a pair of flex arm extensions extending laterally downwardly and then rearwardly on opposite sides of the head of a wearer, each extension having a distal end engaging an inwardly curved portion on the posterior of the head of a wearer.

16. A bicycle helmet comprising:

a shell assembly substantially covering a top portion of a wearer's head and having opposite sides; and a pair of articulated arms, each of said articulated arms having a proximal end and a distal end, said proximal ends being releasably connected to opposite sides of said helmet shell and said distal ends engaging an inwardly curved portion of the head of the wearer, said articulated arms being resiliently flexible when the helmet is donned to provide a resilient pressure against said portion of the head of the wearer thereby providing a more securely helmet.

17. A bicycle helmet comprising:

a shell assembly substantially covering a top portion of a wearer's head and having opposite sides;

at least one articulated member depending from the shell assembly, the articulated member having a distal end; and resilient flex means for allowing the distal end of the articulated member to resiliently flex rearward when the helmet is donned to provide a resilient forward pressure against an inwardly curved portion on the posterior of a wearer's head, thereby providing a more securely fitted helmet;

at least a portion of a proximal end of the articulated member received in a complementary shaped slot in the shell assembly, the proximal end including a barb for engaging a pocket in the shell assembly adjacent to and communicating with the slot, thereby securing the articulated member to the shell assembly.

18. A bicycle helmet comprising:

a shell assembly substantially covering a top portion of a wearer's head and having opposite sides;

at least one articulated member depending from the shell assembly, the articulated member having a distal end; and resilient flex means for allowing the distal end of the articulated member to resiliently flex rearward when the helmet is donned to provide a resilient forward pressure against an inwardly curved portion on the posterior of a wearer's head, thereby providing a more securely fitted helmet;

said shell assembly having a front half, a rear half, an interior surface and an exterior surface, and wherein the shell assembly includes at least one arcuate passage therein for receiving at least a portion of a proximal end of the articulated member, the arcuate passage extending through the interior surface of the rear half and upward within the shell assembly towards the front half, and wherein the shell assembly includes a pocket above and communicating with the arcuate passage for engaging a resiliently flexible barb on the proximal end, thereby securing the articulated member to the shell assembly.

19. A bicycle helmet comprising:

a shell assembly substantially covering a top portion of a wearer's head and having opposite sides;

at least one articulated member depending from the shell assembly, the articulated member having a distal end; and resilient flex means for allowing the distal end of the articulated member to resiliently flex rearward when the helmet is donned to provide a resilient forward pressure against an inwardly curved portion on the posterior of a wearer's head, thereby providing a more securely fitted helmet;

said shell assembly having an exterior surface and an interior surface which defines an interior cavity, further comprising:

a first shell portion having a first void extending downward into the shell assembly through an opening in the exterior surface, the first void having a maximum width and length no larger than a width and length, respectively, of the opening in the exterior surface, a bottom of the first void being defined by an arcuate surface generally extending rearward and further downward, the first void communicating with the interior cavity through a slit at a bottom rear end of the arcuate surface;

a second shell portion having a second void extending upward into the shell assembly through an opening in the interior surface, the second void being laterally offset and directly adjacent to the first void and communicating therewith through an overlap region, the second void having a maximum width and length no larger than a width and length, respectively, of the opening in the interior surface, a top of the second void being defined by a complementary arcuate surface and a pocket above the complementary arcuate surface, the first and second voids cooperating to form an arcuate passage in the shell assembly for accommodating at least a portion of a proximal end of the articulated member, the arcuate passage partially defined underneath by the arcuate surface and on top by the complementary arcuate surface and communicating with the interior cavity partially through the slit; and a resiliently flexible barb protruding rearward and upward from the proximal end of the articulated member and able to flex downward substantially parallel with the proximal end to allow the proximal end to be inserted through the slit into the arcuate passage, the barb being able to return to a non-flexed position and engage the pocket to retain the proximal end of the articulated member in the arcuate passage.

20. A bicycle helmet according to claim 19 wherein the shell assembly includes a recess on an interior surface extending rearward from adjacent the slit for accommodating a mid-portion of the articulated member, the recess allowing a bottom arcuate surface of the articulated member to form a substantially continuous arcuate surface with the interior surface of the shell assembly forward of the slit.

21. A bicycle helmet according to claim 19 further comprising a tab protruding from the proximal end and engaging an inside wall of at least one of the voids adjacent the arcuate passage, thereby stabilizing the articulated member from lateral movement.

22. A bicycle helmet having a shell assembly for substantially covering a top portion of a wearer's head and having an interior surface, an exterior surface, a front half, a rear half, and opposite sides and at least one articulated member depending from the shell assembly and having a proximal end and a distal end, the distal end being positioned to engage the occipital region of the head of the wearer characterized in that the helmet comprises resilient forward biasing means which biases the distal end of the articulated member upwardly and inwardly towards the inwardly curving portion of the occipital region of the head of the wearer and the articulated member itself resiliently biasing the distal end of the articulated member thereby securely fitting the helmet and allowing rearward movement of the distal end of the articulated member against the bias to facilitate donning the helmet.

23. A bicycle helmet as claims in claim 22 characterized in that the resilient biasing means comprises means connecting said articulated member and said opposite sides of said shell assembly including elastic means.

24. A bicycle helmet as claimed in claim 22 further comprising means connecting said articulated member and said opposite sides of said shell assembly and means for adjusting the length of the connection between the articulated member and the opposite sides of the shell assembly thereby allowing a wearer to increase or decrease the resilient forward pressure applied through the articulated member against a wearer's head.

25. A bicycle helmet as claimed in claim 24 in which said adjusting means comprises a hook and loop type fastener.

26. A bicycle helmet as claimed in claim 22 characterized in that the distal end of said articulated member is t-shaped and inwardly curved in a lateral direction, thereby forming with said inwardly curving articulated member a substantially semi-spherical recess for receiving the occipital portion of a wearer's head.

* * * * *